US010227770B2

(12) United States Patent
Delfeld

(10) Patent No.: US 10,227,770 B2
(45) Date of Patent: Mar. 12, 2019

(54) CONNECTION PART

(71) Applicant: Marc Delfeld, Limal (BE)

(72) Inventor: Marc Delfeld, Limal (BE)

( * ) Notice: Subject to any disclaimer, the term of this patent is extended or adjusted under 35 U.S.C. 154(b) by 0 days.

(21) Appl. No.: 15/884,667

(22) Filed: Jan. 31, 2018

(65) Prior Publication Data

US 2018/0148920 A1 May 31, 2018

Related U.S. Application Data

(63) Continuation-in-part of application No. PCT/BE2016/000035, filed on Jul. 29, 2016.

(30) Foreign Application Priority Data

Jul. 31, 2015 (BE) ..... 2015/0191

(51) Int. Cl.

| | |
|---|---|
| ***E04B 1/10*** | (2006.01) |
| ***E04B 1/26*** | (2006.01) |
| ***E04B 1/41*** | (2006.01) |
| ***E04B 2/56*** | (2006.01) |
| ***E04B 2/70*** | (2006.01) |
| ***E04F 17/08*** | (2006.01) |

(52) U.S. Cl.

CPC ..... *E04B 1/2608* (2013.01); *E04B 1/40* (2013.01); *E04B 2/562* (2013.01); *E04B 2/70* (2013.01); *E04B 1/10* (2013.01); *E04B 2001/2644* (2013.01); *E04B 2001/2652* (2013.01); *E04F 17/08* (2013.01)

(58) Field of Classification Search

CPC . E04B 1/2608; E04B 2/70; E04B 1/40; E04B 2/562; E04B 2001/2652; E04B 2001/2644; E04B 1/10; E04F 17/08

See application file for complete search history.

(56) References Cited

U.S. PATENT DOCUMENTS

| | | | | |
|---|---|---|---|---|
| 4,536,101 A * | 8/1985 | Jones | ..... | E04B 1/2608 403/232.1 |
| 5,092,097 A * | 3/1992 | Young | ..... | E04B 1/2608 52/264 |
| 5,467,570 A | 11/1995 | Leek | | |
| 6,430,890 B1 * | 8/2002 | Chiwhane | ..... | E04B 1/2403 52/655.1 |

(Continued)

FOREIGN PATENT DOCUMENTS

| | | |
|---|---|---|
| DE | 29707800 U1 | 7/1997 |
| DE | 102007049332 A1 | 4/2009 |

(Continued)

OTHER PUBLICATIONS

English Translation of the Written Opinion for PCT/BE2016/000035 (8 pages) (Year: 2017).*

(Continued)

*Primary Examiner* — Rodney Mintz

(74) *Attorney, Agent, or Firm* — Hovey Williams LLP

(57) ABSTRACT

The invention relates to a structure comprising at least four wooden beams attached to one another by means of connection parts, said metal connection parts (1) having flats that are supported on the faces of a longitudinal channel (G1 or G2) of a first I-shaped or U-shaped beam (PU, PI) and at least one flat supported on at least the central web (2) of another beam (P).

41 Claims, 20 Drawing Sheets

(56) References Cited

U.S. PATENT DOCUMENTS

| | | | | |
|---|---|---|---|---|
| 7,216,465 | B2 * | 5/2007 | Saldana | E04B 1/2403 52/655.1 |
| D576,472 | S * | 9/2008 | Gaiardo | D8/354 |
| 7,793,482 | B2 * | 9/2010 | Becker | E04B 2/825 52/290 |
| 8,733,061 | B1 * | 5/2014 | McDonald | E04B 7/045 52/300 |
| 9,938,709 | B2 * | 4/2018 | Daudet | E04B 1/2403 |
| 2008/0115447 | A1 * | 5/2008 | Morse | E04B 1/003 52/712 |
| 2015/0082735 | A1 | 3/2015 | Truckner | |
| 2017/0058505 | A1 * | 3/2017 | Daudet | E04B 1/2403 |
| 2018/0202144 | A1 * | 7/2018 | Allen | E04B 1/40 |

FOREIGN PATENT DOCUMENTS

| | | | |
|---|---|---|---|
| EP | 0026397 | A2 | 4/1981 |
| EP | 2546424 | A2 | 1/2013 |

OTHER PUBLICATIONS

International Search Report from related PCT/BE2016/000035 dated Dec. 12, 2016 (3 pages).

* cited by examiner

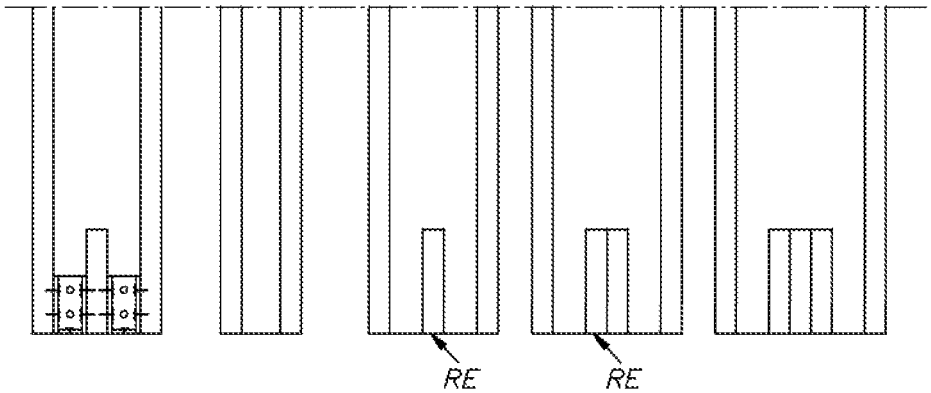
Fig.26
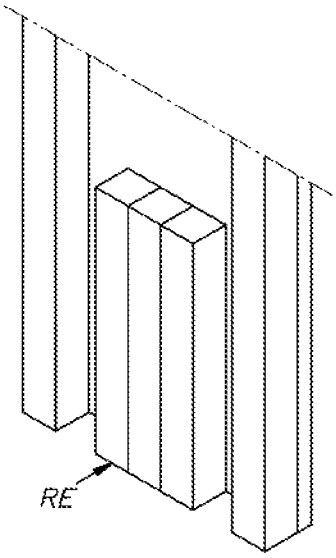

CONNECTION PART

CROSS REFERENCE APPLICATION

The present application is a continuation in part application of PCT application PCT/BE 2016/000035 filed on Jul. 29, 2016, published on Feb. 9, 2017 and claiming the benefit of the priority of Belgian patent application BE2015/0191 filed on Jul. 31, 2015.

ABSTRACT OF THE DISCLOSURE

The invention relates to a structure comprising at least four wooden beams attached to one another by means of connection parts, said metal connection parts (1) having flats that are supported on the faces of a longitudinal channel (G1 or G2) of a first I-shaped or U-shaped beam (PU, PI) and at least one flat supported on at least the central web (2) of another beam (P).

The present invention relates also to a connection part between two wooden beams.

THE STATE OF THE ART

In constructions, wooden beams that are connected to one another by means of L-shaped connection parts are used increasingly.

In the recent constructions, wooden composite beams, in particular wooden composite beams, are used increasingly. Wooden composite beams are understood to mean beams produced from wooden fibers or wooden sheets attached to one another by means of a binder or a glue. In particular, a wooden composite beams is an I-shaped beam of which the wings are of the glued laminate type and of which the web is made of a wood fiber agglomerate.

The connection of these I-shaped beams to one another is achieved, in particular, by means of L-shaped corner pieces made of steel, made of galvanized steel, in particular. This type of connection makes it possible to obtain good results, although not optimal results, in particular when the I-shaped beams have to be attached to one another at right angle.

In addition, the connecting of beams having a large width, for example, more than 10 to 15 cm (3.93701 to 5.90551 inches), is often not optimal in terms of thermal insulation and/or facility of connection at right angles with correct positioning, making it difficult then to easily obtain a rectangular structure including correct positioning of the beams with respect to one another, and capable of ensuring at least good thermal insulation and excellent resistance to vibrations.

In the present description, a solid wooden beam is understood to mean a solid beam made of wood or wood fibers having a substantially rectangular solid transverse section with a thickness of at least 2 cm (0.787402 inches), for example, with a thickness of 3 to 10 cm (1.1811 to 3.93701 inches). The solid web beam is, for example, a beam coming from a tree (beam advantageously treated) or a beam consisting of a series of wooden sheets glued to one another in order to form a solid beam. (Referred to as glued laminate).

BRIEF DESCRIPTION OF THE INVENTION

The invention essentially relates to:

(i) structure comprising at least four wooden beams each comprising a wooden web, said beams being attached to one another so as to define at least one substantially rectangular frame, in which at least two of said four beams defining a substantially rectangular frame are I-shaped or U-shaped wooden beams, each I-shaped or U-shaped beam including at least (a) a planar central wooden web (2) having two opposite faces, a first longitudinal edge, a second longitudinal edge opposite to the first longitudinal edge, a first lateral end edge and a second lateral end edge opposite to the first lateral end edge, (b) a first longitudinal wooden wing (3) (advantageously comprising a series of wooden sheets glued one another, the wooden sheets can have for example a thickness of 0.5 mm to 6 mm (0.019685 to 0.23622 inches), such as 1 mm (0.0393701 inches), 2 mm (0.0787402 inches), 3 mm (0.11811 inches) and 4 mm (0.15748 inches), said first longitudinal wooden wing (3) extending along the first longitudinal edge, (c) a second longitudinal wooden wing (3) (advantageously comprising a series of wooden sheets glued one another, the wooden sheets can have for example a thickness of 0.5 mm to 6 mm (0.019685 to 0.23622 inches), such as 1 mm (0.0393701 inches), 2 mm (0.0787402 inches), 3 mm 0.11811 inches) and 4 mm (0.15748 inches), said second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, whereby said at least first longitudinal wooden wing and second longitudinal wooden wing (3) are attached to said planar central wooden web (2) while defining, between said at least first longitudinal wing and second longitudinal wing (3), at least one longitudinal channel (G1,G2) with a bottom extending along the planar central wooden web and with two opposite faces extending from the said bottom, said opposite faces of a considered channel being distant the one to the other by a distance defining the width of the considered channel and defining therebetween a channel volume, whereby said at least four wooden beams defining the substantially rectangular frame are attached to one another by means of at least one metal connection part (1) and fixation means connecting the said at least one metal connection part to wooden beams of said at least four wooden beams defining the substantially rectangular frame, said at least one connection metal part being formed by folding a metal plate element, whereby each of said at least one metal connection part (1) has at least a first flat being supported on one of the opposite faces of a considered longitudinal channel (G1,G2) of a considered I-shaped or U-shaped beam (PU,PI), a second flat being supported on the other of said opposite faces of the considered longitudinal channel (G1, G2) of said considered I-shaped or U-shaped beam (PU, PI) and at least one third flat that is supported at least on the central wooden web (2) of another beam (P) connected to said considered I-shaped or U-shaped beam (PU, PI), said metal connection part between a U-shaped or I-shaped beam (PU, PI) and another beam comprising:

a first substantially rectangular portion (10) having two lateral end edges (11, 12) and two longitudinal edges (13, 14) which are spaced apart from one another by a distance corresponding substantially to the width of a longitudinal channel (G1, G2) of the I-shaped or U-shaped beam in consideration (PI, PU), a first longitudinal reinforcement fold (20) lengthening the first portion along a first (13) of the longitudinal edges thereof (13, 14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said first and second longitudinal reinforcement folds (20, 21) having a maximum height (HM) measured from the first portion (10), said maximum height being adapted so that, when the first portion (10) is supported on the bottom of a considered channel (G1, G2) of the I-shaped or U-shaped beam in consideration (PI, PU), the longitudinal reinforcement folds (20, 21) extend in the channel volume defined by said considered channel (G1, G2) and are the first flat (20) and the second flat (21) contacting the opposite faces of the considered channel (G1,G2), and a second portion (30) lengthening the first portion (10) along one (11) of the lateral end edges thereof (11, 12), said second portion (30) extending in a plane substantially perpendicular to the plane in which the first portion (10) extends, the said second portion (30) having a maximum length (LM), calculated starting from said one lateral end edge (11) of the first portion (10), which is at least equal to 1.2 times the maximum height (HM) of the said first and second longitudinal reinforcement folds (20, 21).

Wherein the first portion (10), the first longitudinal reinforcement fold (20), the second longitudinal reinforcement fold (21) and the second portion (30) of said metal connection part are provided with openings (41,42) cooperating with said fixation means (50).

As well as to (ii) a structure comprising at least four wooden beams each comprising a wooden web, said beams being attached to one another so as to define at least one substantially rectangular frame, in which at least two of said four beams defining a substantially rectangular frame are I-shaped or U-shaped wooden beams, each I-shaped or U-shaped beam including at least (a) a planar central wooden web (2) having two opposite faces, a first longitudinal edge, a second longitudinal edge opposite to the first longitudinal edge, a first lateral end edge and a second lateral end edge opposite to the first lateral end edge, (b) a first longitudinal wooden wing (3) (advantageously comprising a series of wooden sheets glued one another, the wooden sheets can have for example a thickness of 0.5 mm to 6 mm (0.019685 to 0.23622 inches), such as 1 mm (0.0393701 inches), 2 mm (0.0787402 inches), 3 mm 0.11811 inches) and 4 mm (0.15748 inches), said first longitudinal wooden wing (3) extending along the first longitudinal edge, (c) a second longitudinal wooden wing (3) (advantageously comprising a series of wooden sheets glued one another, the wooden sheets can have for example a thickness of 0.5 mm to 6 mm (0.019685 to 0.23622 inches), such as 1 mm (0.0393701 inches), 2 mm (0.0787402 inches), 3 mm 0.11811 inches) and 4 mm (0.15748 inches), said second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, and (d) in the vicinity of at least one lateral end edge of the planar wooden web, at least one longitudinal intermediate wooden reinforcement situated between said first and second longitudinal wooden wings (3), whereby said at least first longitudinal wooden wing, said second longitudinal wooden wing (3) and said longitudinal intermediate wooden reinforcement are attached to said planar central wooden web (2) while defining along one face of the central wooden web (2), in the vicinity of the at least one lateral end edge, between said at least first longitudinal wing and second longitudinal wing (3), at least a first longitudinal channel and a second longitudinal channel distinct from the said first longitudinal channel, said first longitudinal channel and said second longitudinal channel having each a bottom extending along the planar central wooden web and with two opposite faces extending from the said bottom, said opposite faces of a considered channel being selected from the group consisting of a face of the first longitudinal wooden wing, a face of the second longitudinal wing and faces of the at least one intermediate wooden reinforcement, the said two opposite faces being distant the one to the other by a distance defining the width of the considered channel and defining therebetween a channel volume, whereby said at least four wooden beams defining the substantially rectangular frame are attached to one another by means of at least two distinct metal connection parts (1) and fixation means connecting the said at least two metal connection parts (1) to wooden beams of said at least four wooden beams defining the substantially rectangular frame, said at least one connection metal part being formed by folding a metal plate element, whereby each of said at least two metal connection parts (1) has at least a first flat being supported on one of the opposite faces of a considered longitudinal channel (G1,G2) of a considered I-shaped or U-shaped beam (PU,PI) with at least one intermediate wooden reinforcement, a second flat being supported on the other of said opposite faces of the considered longitudinal channel (G1, G2) of said considered I-shaped or U-shaped beam (PU, PI) with at least one intermediate wooden reinforcement, and at least one third flat that is supported at least on the central wooden web (2) of another beam (P) connected to said considered I-shaped or U-shaped beam (PU, PI) with the at least one intermediate wooden reinforcement, said metal connection part between a U-shaped or I-shaped beam (PU, PI) and another beam comprising:

a first substantially rectangular portion (10) having two lateral end edges (11, 12) and two longitudinal edges (13, 14) which are spaced apart from one another by a distance corresponding substantially to the width of a longitudinal channel (G1, G2) of the I-shaped or U-shaped beam in consideration (PI, PU) provided with the said at least one intermediate wooden reinforcement, a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said first and second longitudinal reinforcement folds (20, 21) having a maximum height (HM) measured from the first portion (10), said maximum height being adapted so that, when the first portion (10) is supported on the bottom of a considered channel (G1, G2) of the I-shaped or U-shaped beam in consideration (PI, PU) provided with the said at least one intermediate wooden reinforcement, the longitudinal reinforcement folds (20, 21) extend in the channel volume defined by said considered channel (G1, G2) and are the said first flap (20) and the second flap (21) contacting the opposite faces of the considered channel (G1,G2), and a second portion (30) lengthening the first portion (10) along one (11) of the lateral end edges thereof (11, 12), said second portion (30) extending in a plane substantially perpendicular to the plane in which the first portion (10)

extends, the said second portion (30) having a maximum length (LM), calculated starting from said one lateral end edge (11) of the first portion (10), which is at least equal to 1.2 times the maximum height (HM) of the said first and second longitudinal reinforcement folds (20, 21).

wherein the first portion (10), the first longitudinal reinforcement fold (20), the second longitudinal reinforcement fold (21) and the second portion (30) of said metal connection part are provided with openings (41,42) cooperating with said fixation means (100).

In particular, the invention relates to a structure comprising at least four wooden beams each comprising a wooden web, said beams being attached to one another so as to define at least one substantially rectangular frame, in which at least two of said four beams are I-shaped or U-shaped wooden beams defining a substantially rectangular frame, each I-shaped or U-shaped beam including a planar central wooden web (2) having two opposite faces, two longitudinal edges and two lateral end edges, at least (a) two longitudinal wooden wings (3) spaced apart from one another extending along one of the two opposite faces in the vicinity of the longitudinal edges, and (c) in the vicinity of the lateral end edges of the central wooden web (2), one or more longitudinal intermediate wooden reinforcements situated between said two longitudinal wooden wings (3), said at least two longitudinal wooden wings (3) and the optional reinforcement(s) being attached to said planar central web (2) in such a manner as to define, between said two longitudinal wings (3) and the reinforcement(s), one or more longitudinal channels (G1, G2), said at least four wooden beams being attached to one another by means of a set of at least two separate metal connection parts (1) having flats that are supported on the faces of a longitudinal channel (G1 or G2) of a first I-shaped or U-shaped beam (PU, PI) and at least one flat that is supported at least on the central web (2) of another beam (P).

The metal connection part or each of the metal connection parts or of a set of connection parts between a U-shaped or I-shaped beam (PU, PI) and another beam of a structure of the invention comprises:

a first substantially rectangular portion 10 having two lateral edges (11, 12) and two longitudinal edges (13, 14) which are spaced apart from one another by a distance corresponding substantially to the width of a longitudinal channel (G1 or G2) of the I-shaped or U-shaped beam in consideration (PI, PU), a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) (measured from the first portion (10)) adapted so that, when the first portion (10) is supported on the bottom of the channel (G1 or G2) of the I-shaped or U-shaped beam in consideration (PI, PU), the longitudinal folds (20, 21) extend in the volume defined by said channel (G1 or G2), and a second portion (30) lengthening the first portion (10) along one (11) of the lateral edges thereof (11, 12), said second portion (30) extending in a plane perpendicular to the plane in which the first portion (10) extends, the second portion (30) moreover having a maximum length (LM), calculated starting from said lateral edge (11) of the first portion (10), which is at least equal to 1.2 times the maximum height (HM) of the longitudinal folds (20, 21).

Each of the connection parts are advantageously a metal connection part obtained by folding of a metal plate, said connection part being suitable for connecting a U-shaped or I-shaped beam (PU, PI) and another beam, said I-shaped or U-shaped beam defining with respect to their planar central wooden web and their longitudinal wooden wings in the vicinity of their lateral ends at least one longitudinal channel, whereby said connection part comprises:

a first substantially rectangular portion 10 having two lateral edges (11, 12) and two longitudinal edges (13, 14) which are spaced apart from one another by a distance corresponding substantially to the width of one of said longitudinal channel (G1, G2) of the I-shaped or U-shaped beam in consideration (PI, PU), the said first portion having openings (41,42) for fixation means (100) adapted to attach the said first portion to the planar central wooden web;

a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) adapted so that, when the first portion (10) is supported on the bottom of one channel (G1, G2) of the I-shaped or U-shaped beam in consideration (PI, PU), the longitudinal folds (20, 21) extend in the volume defined by said one channel (G1, G2), and a second portion (30) lengthening the first portion (10) along one (11) of the lateral edges thereof (11, 12), said second portion (30) extending in a plane perpendicular to the plane in which the first portion (10) extends, the second portion (30) moreover having a maximum length (LM), calculated starting from said lateral edge (11) of the first portion (10), which is at least equal to 1.2 times the maximum height (HM) of the longitudinal folds (20, 21) and preferably 1.5 to 10 times the maximum height HM of the longitudinal folds, and in particular a maximum length (LM) which is at least equal to two to ten times the maximum height (HM) of the longitudinal folds, the said second portion being intended to contact the planar wooden web of another beam and being provided with openings (41,42) for fixation means (100), in which the second portion (30) moreover having a maximum length (LM), calculated starting from said lateral edge (11) of the first portion (10), which is at least equal to two times the maximum height (HM) of the longitudinal folds (20, 21), in which the longitudinal folds (20, 21) extend in the spatial zone situated above the plane of the second portion (30) and including the first portion (10), and in which the lateral edges (31, 32) of the second portion (30) each form an angle (A1, A2) of less than 85° with the lateral edge (11) of the first portion (10) from which the second portion (30) extends.

The presence of one or more intermediate wooden reinforcements facilitates the positioning of an I-shaped or U-shaped beam on another beam before fastening them to one another, and facilitates a better fastening by means of at least two connection parts, and facilitates avoiding the formation of a thermal bridge between the adjacent connection parts.

The structure according to the present invention advantageously has one or more of the following features, advantageously a combination of these features:

at least two of said four beams defining a substantially rectangular frame are I-shaped or U-shaped wooden beams, each I-shaped or U-shaped beam further including at least one longitudinal intermediate wooden reinforcement situated between said two longitudinal wooden wings (3), said at least two longitudinal wooden wings (3) and the reinforcement(s) being attached to said planar central web (2) in such a manner as to define, between said two longitudinal wings (3) and the reinforcement, at least two distinct longitudinal channels (G1, G2).

The structure includes at least four I-shaped or U-shaped wooden beams defining a substantially rectangular frame, each I-shaped or U-shaped beam including a planar central wooden web (2) having two opposite faces, a first longitudinal edge, a second longitudinal edge opposite to the first longitudinal edge, a first lateral end edge and a second lateral end edge opposite to the said first lateral end edges, at least (a) a first longitudinal wooden wing (3) comprising a series of wooden sheets glued one another, said first longitudinal wooden wing (3) extending along the first longitudinal edge, (b) a second longitudinal wooden wing (3) comprising a series of wooden sheets glued one another, said second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, and, whereby said at least first longitudinal wooden wing and second longitudinal wooden wing (3) are attached to said planar central web (2), while defining between said at least first longitudinal wooden wing and second longitudinal wooden wing (3), at least one longitudinal channel—(G1,G2) with a bottom extending along the planar central wooden web and with two opposite faces extending from the said bottom, said opposite faces of a considered channel being distant the one to the other by a distance defining the width of the considered channel and defining therebetween a channel volume, whereby said at least four I-shaped or U-shaped wooden beams are attached to one another by means of at least one metal connection part (1) and fixation means connecting the said at least one metal connection part to wooden beams of said at least four wooden beams defining the substantially rectangular frame, said at least one connection metal part being formed by folding a metal plate element, whereby each of the said at least one metal connection part connecting a first beam of said four I-shaped or U-shaped beams defining the substantially rectangular frame to a second beam of said four I-shaped or U-shaped beams defining the substantially rectangular frame has at least (*) a first flat (20) being supported on one of the opposite faces of a considered channel (G1,G2) of the first beam, as well on one of the opposite faces of a considered channel of the said second beam, and () a second flat (21) being supported on the other of the opposite faces of the considered channel (G1,G2**) of the first beam, as well on the other of the opposite faces of the considered channel of the said second beam.

The structure comprises at least four I-shaped or U-shaped wooden beams defining a substantially rectangular frame, each I-shaped or U-shaped beam including a planar central wooden web (2) having two opposite faces, two longitudinal edges and two lateral end edges, at least (a) two longitudinal wooden wings (3) spaced apart from one another extending along one of the two opposite faces in the vicinity of the longitudinal edges, and (c) optionally in the vicinity of the lateral end edges of the central wooden web (2), one or more longitudinal intermediate reinforcements situated between said two longitudinal wooden wings (3), said at least two longitudinal wooden wings (3) and the optional reinforcement(s) being attached to said planar central web (2) in such a manner as to define, between said two longitudinal wings (3), or between said longitudinal wings and the reinforcement(s), one or more longitudinal channels, said at least four wooden beams being attached to one another by means of at least one metal connection part (1) having flats that are supported on the faces of a longitudinal channel (G1 or G2) of a first I-shaped or U-shaped beam (PU, PI) and on the longitudinal faces of a longitudinal channel (G1 or G2) of another I-shaped or U-shaped beam.

the planar central wooden web (2) of the I-shaped or U-shaped beams of the substantially rectangular frame extends each within a plane, and in which the wings (3) of one of the said I-shaped or U-shaped beams of the substantially rectangular frame comprises glued wooden sheets extending each in a plane parallel to the plane of the planar central wooden web (2).

the wings and the optional reinforcements are elements formed by wooden sheets glued to one another, said sheets extending in a plane parallel to the plane of the central web (2).

the (intermediate) reinforcements or longitudinal intermediate wooden reinforcements have a length of 20 to 50 cm (7.87402 to 19.685 inches).

for each of the connection parts (1), the longitudinal folds (20, 21) extend in a spatial zone situated above the plane of the second portion (30) and including the first portion (10).

each of the at least one connection part (1) connecting the one beam to another beam of the said four beams defining the substantially rectangular frame defines a spatial zone with a first face extending along the first portion (10) and with a second face extending along the second portion, whereby the first longitudinal fold (20) and the second longitudinal fold (21) extend in the said spatial zone of the said considered connection part.

said second portion (30) has a shape or portion or section (end section) of substantially trapezoidal or triangular shape with opposite lateral edges or opposite first and second lateral edges (31, 32) that approach one another the farther they get from said lateral edge (11) of the first portion (10).

said second portion (30) has a shape or portion or section of substantially trapezoidal with opposite lateral edges (31, 32) that approach one another the farther they get from said lateral edge (11) of the first portion.

the lateral edges (31, 32) of the second portion (30) each form an angle (A1, A2) of less than 85°, such as less than 80° and advantageously of less than 75° with the lateral edge (11) of the first portion (10) from which the second portion (30) extends.

the first and second lateral edges (31, 32) of the second portion (30) have each at least an inclined edge portion, the said inclined edge portion of the first lateral edge and the said inclined portion of the second lateral edge extend along lines forming an angle (A1, A2) of less than 85° with the lateral edge (11) of the first portion (10) from which the said second portion (30) extends.

for the connection parts, the second portion (30) lengthening the first portion (10) along one (11) of the lateral edges thereof (11,12), said second portion (30) extending in a plane perpendicular to the plane in which the first portion (10) extends, said second portion (30) having a substantially trapezoidal or triangular shape with opposite lateral edges (31, 32) that approach one another the farther they get from said lateral edge (11) of the first portion, the second portion (30) moreover having a maximum length (LM), calculated starting from said lateral edge (11) of the first portion (10), which is at least equal to two times the maximum height (HM) of the longitudinal folds (20, 21), in which the longitudinal folds (20, 21) advantageously extend in the spatial zone situated above the plane of the second portion (30) and including the first portion (10), and in which the lateral edges (31, 32) of the second portion (30) each form preferably an angle (A1, A2) of less than 85°, such as less than 80° and advantageously of less than 75° with the lateral edge (11) of the first portion (10) from which the second portion (30) extends.

the second portion (30) has a maximum length (LM), calculated starting from said lateral edge (11) of the first portion (10), which is 1.5 times to 10 times the maximum height HM of the longitudinal folds, and in particular a maximum length (LM) which is at least equal to two times to ten times the maximum height (HM) of the longitudinal folds. (for example, 1.5; 1.8; 2; 2.5, 3 times the height HM).

the second portion (30) has a substantially triangular shape, the lateral edges (31, 32) of the second portion (30) forming an angle (A1, A2) of 45° to 65° and in particular of 60° with the lateral edge (11) of the first portion (10) from which the second portion (30) extends.

said second portion (30) has a shape or section of substantially triangular shape with opposite first and second lateral edges (31, 32) that approach one another the farther they get from said lateral edge (11) of the first portion (10), while the second portion (30) has a substantially triangular shape, the lateral edges (31, 32) of the second portion (30) forming an angle (A1, A2) of 45° to 65° with the lateral edge (11) of the first portion (10) from which the second portion (30) extends.

the wooden wings and/or the wooden reinforcements comprises a series of wooden sheets glued one another, the wooden sheets having for example a thickness of 0.5 mm to 6 mm (0.019685 to 0.23622 inches), such as 1 mm (0.0393701 inches), 2 mm (0.0787402 inches), 3 mm (0.11811 inches) and 4 mm (0.15748 inches).

at least the first portion (10) and the second portion (30) of the metal connection parts (1) have openings (41, 42) for the passage of fastening means (50).

the metal connection parts are produced by folding a metal sheet made of steel with a thickness of 2 to 6 mm (0.0787402 to 0.23622 inches), such as from 2 to 4 mm (0.0787402 to 0.15748 inches), for example 2 mm (0.0787402 inches), 3 mm (0.11811 inches) and 4 mm (0.15748 inches).

the first portion (10) and the second portion (30) each have at least two types of substantially circular openings (41, 42) of different diameters.

the first and second portions (10, 30) have first openings (41) suitable for allowing the passage of a shank of a bolt with a diameter of more than 5 mm, at least one first opening (41) of the second portion (30) of a first connection part, of which the first portion (10) of the part in consideration is housed in the channel (G1 or G2) of an I-shaped wooden beam, being arranged so as to cooperate with a first opening (41) of the first portion (10) of a connection part similar to the first connection part in consideration and which is housed in the channel (G1 or G2) of another I-shaped wooden beam (PI).

the longitudinal folds (20, 21) each have a height of less than 4 cm (0.15748 inches), such as comprised between 0.5 cm to 4 cm (0.19685 to 1.5748 inches), in particular 0.5 to 2.5 cm (0.19685 to 0.984252 inches), preferably approximately 2 cm (0.787402 inches).

the second portion (30) has a maximum height (HM) between 0.5 and 1 times and in particular between 0.65 and 0.75 times the distance separating the longitudinal folds from one another, while the distance separating the longitudinal folds (21, 22) from one another is equal to 5 to 12 times the maximum height (HM) of the longitudinal folds (20, 21).

the two lateral edges (11, 12) of the first portion (10) are spaced apart from one another by a distance equal to 1 to 2 times and advantageously 1.2 to 1.6 times the distance separating the longitudinal folds (20, 21) from one another.

The structure includes one or more panels that are supported on the I-shaped or U-shaped beams and/or includes one or more insulating elements situated in the volume defined between the beams.

the I-shaped or U-shaped beams are provided in the vicinity of the first lateral end edge with a first longitudinal intermediate wooden reinforcement and in the vicinity of the second lateral end edge with a second longitudinal intermediate wooden reinforcement separated from the said first longitudinal intermediate wooden reinforcement.

The structure includes at least four I-shaped or U-shaped wooden beams defining a substantially rectangular frame, each I-shaped or U-shaped beam including at least (a) a planar central wooden web (2) having two opposite faces, a first longitudinal edge, a second longitudinal edge opposite to the first longitudinal edge, a first lateral end edge and a second lateral end edge opposite to the first lateral end edge, (b) a first longitudinal wooden wing (3) comprising a series of wooden sheets glued one another, said first longitudinal wooden wing (3) extending along the first longitudinal edge, (c) a second longitudinal wooden wing (3) comprising a series of wooden sheets glued one another, said second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, (d) in the vicinity of the first lateral end edge, a first longitudinal intermediate wooden reinforcement and (e) in the vicinity of the second lateral end edge, a second longitudinal intermediate wooden reinforcement separated from the said first longitudinal intermediate wooden reinforcement.

the planar central wooden web (2) of the I-shaped or U-shaped beams of the substantially rectangular frame extends each within a plane, whereby the wings (3) of the at least two I-shaped or U-shaped beams of the substantially rectangular frame comprises glued wooden sheets extending each in a plane parallel to the plane of the planar central wooden web (2), and whereby the optional, but advantageous, longitudinal intermediate wooden reinforcements comprise glued wooden sheets extending each in a plane parallel to the plane of the planar central wooden web (2).

the planar central wooden web (2) of the I-shaped or U-shaped beams of the substantially rectangular frame extends each within a plane, whereby the wings (3) of the at least two I-shaped or U-shaped beams of the substantially rectangular frame comprises glued wooden sheets extending each in a plane parallel to the plane of the planar central wooden web (2), and whereby the optional, but advantageous, longitudinal intermediate wooden reinforcements comprise glued wooden sheets extending (advantageously in the longitudinal direction) each in a plane perpendicular to the plane of the planar central wooden web (2).

the planar central wooden web (2) of the I-shaped or U-shaped beams of the substantially rectangular frame extends each within a plane, whereby the wings (3) of the at least two I-shaped or U-shaped beams of the substantially rectangular frame comprises glued wooden sheets extending each in a plane perpendicular (advantageous extending in the longitudinal direction) to the plane of the planar central wooden web (2), and whereby the optional, but advantageous, longitudinal intermediate wooden reinforcements comprise glued wooden sheets extending each in a plane parallel to the plane of the planar central wooden web (2).

the planar central wooden web (2) of the I-shaped or U-shaped beams of the substantially rectangular frame extends each within a plane, whereby the wings (3) of the at least two I-shaped or U-shaped beams of the substantially rectangular frame comprises glued wooden sheets extending each in a plane (advantageously extending in the longitudinal direction) perpendicular to the plane of the planar central wooden web (2), and whereby the optional, but advantageous, longitudinal intermediate wooden reinforcements comprise glued wooden sheets extending (advantageously in the longitudinal direction) each in a plane perpendicular to the plane of the planar central wooden web (2). and a combination of such particulars.

The invention also relates to a metal connection part for a structure according to the invention, said metal connection part between a U-shaped or I-shaped beam (PU, PI) and another beam comprising:

a first substantially rectangular portion 10 having two lateral edges (11, 12) and two longitudinal edges (13, 14) which are spaced apart from one another by a distance corresponding substantially to the width of a longitudinal channel (G1 or G2) of the I-shaped or U-shaped beam in consideration (PI, PU), a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) adapted so that, when the first portion (10) is supported on the bottom of the channel (G1 or G2) of the I-shaped or U-shaped beam in consideration (PI, PU), the longitudinal folds (20, 21) extend in the volume defined by said channel (G1 or G2), and a second portion (30) lengthening the first portion (10) along one (11) of the lateral edges thereof (11, 12), said second portion (30) extending in a plane perpendicular to the plane in which the first portion (10) extends, the second portion (30) moreover having a maximum length (LM), calculated starting from said lateral edge (11) of the first portion (10), which is at least equal to 1.2 times the maximum height (HM) of the longitudinal folds (20, 21) and preferably 1.5 to 10 times the maximum height HM of the longitudinal folds, and in particular a maximum length (LM) which is at least equal to two to ten times the maximum height (HM) of the longitudinal folds (20, 21).

Advantageously, the part has one or more of the following features, preferably a combination of such features:

said second portion (30) has a shape or section of substantially trapezoidal or triangular shape with opposite lateral edges (31, 32) that approach one another the farther they get from said lateral edge (11) of the first portion.

said second portion (30) has a shape or section of substantially trapezoidal shape with opposite lateral edges (31, 32) that approach one another the farther they get from said lateral edge (11) of the first portion (in particular, the portion 30 comprises a first section of substantially rectangular shape lengthened by a section of substantially trapezoidal shape, the trapezoidal section having a free edge situated at a distance LM which is greater than the height HM of the folds, while the rectangular section is situated in a zone at a distance of less than 0.9 times the height HM from the edge 11).

the lateral edges (31, 32) of the second portion (30) each form an angle (A1, A2) of less than 80° and advantageously of less than 75° with the lateral edge (11) of the first portion (10) from which the second portion (30) extends.

for the connection parts, the second portion (30) lengthening the first portion (10) along one (11) of the lateral edges thereof (11,12), said second portion (30) extending in a plane perpendicular to the plane in which the first portion (10) extends, said second portion (30) having a substantially trapezoidal or triangular shape with opposite lateral edges (31, 32) that approach one another the farther they get from said lateral edge (11) of the first portion, the second portion (30) moreover having a maximum length (LM), calculated starting from said lateral edge (11) of the first portion (10), which is at least equal to two times the maximum height (HM) of the longitudinal folds (20, 21), in which the longitudinal folds (20, 21) extend in the spatial zone situated above the plane of the second portion (30) and including the first portion (10), and in which the lateral edges (31, 32) of the second portion (30) each form an angle (A1, A2) of less than 80° and advantageously of less than 75° with the lateral edge (11) of the first portion (10) from which the second portion (30) extends.

the second portion (30) has a maximum length (LM), calculated starting from said lateral edge (11) of the first portion (10), which is at least equal to two to ten times the maximum height (HM) of the longitudinal folds.

the metal connection parts are produced by folding a metal sheet made of steel with a thickness of 2 to 6 mm (0.0787402 to 0.23622 inches), especially from 2 to 4 mm (0.0787402 to 0.15748 inches). Examples of thickness are 2 mm (0.0787402 inches), 3 mm (0.11811 inches), 4 mm (0.15748 inches) and 5 mm (0.19685 inches).

A specific connection part of the invention is a metal connection part obtained by folding of a metal plate, said connection part being suitable for connecting a U-shaped or I-shaped beam (PU, PI) and another beam, said I-shaped or U-shaped beam defining with respect to their planar central wooden web and their longitudinal wooden wings in the vicinity of their lateral ends at least one longitudinal channel, whereby said connection part comprises:

a first substantially rectangular portion 10 having two lateral edges (11, 12) and two longitudinal edges (13, 14) which are spaced apart from one another by a distance corresponding substantially to the width of one of said longitudinal channel (G1, G2) of the I-shaped or U-shaped beam in consideration (PI, PU), the said first portion having openings (41,42) for fixation means (100) adapted to attach the said first portion to the planar central wooden web;

a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) adapted so that, when the first portion (10) is supported on the bottom of one channel (G1, G2) of the I-shaped or U-shaped beam in consideration (PI, PU), the longitudinal folds (20, 21) extend in the volume defined by said one channel (G1, G2), and a second portion (30) lengthening the first portion (10) along one (11) of the lateral edges thereof (11, 12), said second portion (30) extending in a plane perpendicular to the plane in which the first portion (10) extends, the second portion (30) moreover having a maximum length (LM), calculated starting from said lateral edge (11) of the first portion (10), which is at least equal to 1.2 times the maximum height (HM) of the longitudinal folds (20, 21) and preferably 1.5 to 10 times the maximum height HM of the longitudinal folds, and in particular a maximum length (LM) which is at least equal to two to ten times the maximum height (HM) of the longitudinal folds, the said second portion being intended to contact the planar wooden web of another beam and being provided with openings (41,42) for fixation means (100), in which the second portion (30) moreover having a maximum length (LM), calculated starting from said lateral edge (11) of the first portion (10), which is at least equal to two times the maximum height (HM) of the longitudinal folds (20, 21), in which the longitudinal folds (20, 21) extend in the spatial zone situated above the plane of the second portion (30) and including the first portion (10), and in which the lateral edges (31, 32) of the second portion (30) each form an angle (A1, A2) of less than 85° with the lateral edge (11) of the first portion (10) from which the second portion (30) extends.

Advantageously, the second portion (30) has a maximum length (LM), calculated starting from said lateral edge (11) of the first portion (10), which is at least equal to two to ten times the maximum height (HM) of the longitudinal folds.

Thus, the invention relates to a type of connection parts enabling an excellent connection of I-shaped wooden beams connected to one another, connection which makes it possible to ensure a good resistance to vibrations, in particular vibrations due to an earthquake. Such a connection part is useful and advantageous, since, while having a portion that correctly matches the shape of the channel of a beam (while remaining within the volume of the channel), it has a second portion which does not prevent a certain deformation of the longitudinal folds, this second part moreover being capable of some elastic deformation in case of an earthquake or strong winds.

The structure of the invention can therefore have an excellent resistance to horizontal stresses, such as stresses due to earthquake.

In case of severe earthquake, connection parts are able to have some plastic deformation, while preventing the collapse of the buildings, whereby preventing some injury risks for the people inside and outside the building.

According to a particular embodiment, the invention relates to a connection part (1) for a connection between, on the one hand, an I-shaped wooden beam in consideration (PI) including a central web (2) and two wings (3) defining two longitudinal channels (G1, G2) situated on either side of the central web (2), and, on the other hand, an element (E) selected from a base, a panel, a beam, in particular an I-shaped wooden beam, said part being made from a folded metal sheet, said part (1) being suitable for cooperating with a channel (G1 or G2) of a predetermined I-shaped wooden beam (PI), comprising:

A first substantially rectangular portion 10 having two lateral edges (11, 12) and two longitudinal edges (13, 14) which are spaced apart from one another by a distance corresponding substantially to the width of a channel (G1 or G2) of the I-shaped beam in consideration (PI), A first longitudinal reinforcement fold (20) lengthening the first portion along a first (13) of the longitudinal edges thereof (13, 14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) suitable so that, when the first portion (10) is supported on the bottom of the channel (G1 or G2) of the I-shaped beam in consideration (PI), the longitudinal folds (20, 21) extend in the volume defined by said channel (G1 or G2), and a second portion (30) extending the first portion (10) along one (11) of the lateral edges thereof (11, 12), said second portion (30) extending in a plane perpendicular to the plane in which the first portion (10) extends, said second portion (30) having a substantially trapezoidal or triangular shape with opposite lateral edges (31, 32) that approach one another the farther they get from said lateral edge (11) of the first portion, the second portion (30) moreover having a maximum length (LM), calculated starting from said lateral edge (11) of the first portion (10), which is at least equal to two times the maximum height (HM) of the longitudinal folds (20, 21), in which the longitudinal folds (20, 21) extend in the spatial zone situated above the plane of the second portion (30) and including the first portion (10), and in which the lateral edges (31, 32) of the second portion (30) each form an angle (A1, A2) of less than 80° and advantageously of less than 75° with the lateral edge (11) of the first portion (10) from which the second portion (30) extends.

Such a connection part is useful and advantageous, since, while having a portion that correctly matches the shape of the channel of a beam (while remaining within the volume of the channel), it has a second portion which does not prevent a certain deformation of the longitudinal folds, this second part moreover being capable of deformation in case of an earthquake or strong winds.

The part according to this embodiment of the invention advantageously has one or more of the following features, preferably several of the following features:

the second portion (30) has a maximum length (LM), calculated starting from said lateral edge (11) of the first portion (10), which is at least equal to two to ten times the maximum height (HM) of the longitudinal folds and/or the second portion (30) has a substantially triangular shape, the lateral edges (31, 32) of the second portion (30) forming an angle (A1, A2) of 45° to 65° and in particular of 60° with the lateral edge (11) of the first portion (10) from which the second portion (30) extends and/or at least the first portion (10) and the second portion (30) have openings (41, 42) for the passage of fastening means (50) and/or the part is produced from a metal sheet made of steel (in particular galvanized steel, the steel sheet can also be protected by one or more other coatings, if required) with a thickness of 2 to 4 mm and/or the first portion (10) and the second portion (30) each have at least two types of substantially circular openings (41, 42) of different diameter and/or the first and second portions (10, 30) have first openings (41) suitable for allowing the passage of a stem of a bolt with a diameter of more than 5 mm, at least one first opening (41) of the second portion (30) of a part, of which the first portion (10) of the part in consideration is housed in the channel (G1 or G2) of an I-shaped wooden beam, being arranged so as to cooperate with a first opening (41) of the first portion (10) of a part similar to the part in consideration and which is housed in the channel (G1 or G2) of another I-shaped wooden beam (PI) and/or the longitudinal folds (21, 22) each have a height of less than 2 cm (0.787402 inches), in particular of 0.5 cm to 1.5 cm (0.19685 to 0.590551 inches), preferably of approximately 1 cm (0.393701 inches)

the longitudinal folds (21, 22) have rounded angles and/or the second part has one or more rounded angles and/or the longitudinal folds each have at least two 6 holes for ensuring a connection by connection means (nails, screws, bolts, etc.) to a wing of an I-shaped beam and/or the second portion (30) has a maximum height (HM) between 0.5 and 1 times and in particular between 0.65 and 0.75 times the distance separating the longitudinal folds from one another, while the distance separating the longitudinal folds (21, 22) from one another is equal to 5 to 12 times the maximum height (HM) of the longitudinal folds (21, 22) and/or the two lateral edges (11, 12) of the first portion (10) are spaced apart from one another by a distance equal to 1 to 2 times and advantageously 1.2 to 1.6 times the distance separating the longitudinal folds (21, 22) from one another and/or The reinforcement longitudinal fold (20,21) are welded to the second portion (30), by one or more welding points or welding lines, and/or a combination of such features.

The invention also relates to a system for connecting a first wooden beam of a framework of a first wall (advantageously with one or more panels which are themselves used for internal and external bracing) comprising at least one solid wooden beam connected to an I-shaped wooden beam (PI 1) by means of a part according to the invention, to a second wooden beam of a framework of a second wall comprising at least one solid web wooden beam connected to an I-shaped wooden beam (PI 2) by means of a part according to the invention, said system including said two parts according to the invention connecting a solid web wooden beam to an I-shaped wooden beam, and fastening means for extending between said two parts, the first portion of a first part being housed in a channel of an I-shaped beam of the framework of the first wall, while the second portion of the second part is housed in a channel of an I-shaped wooden beam of the framework of a second wall, fastening means passing through a wooden beam of the framework of the first wall and a wooden beam of the framework of the second wall in order to rigidly connect the parts to one another and attach the walls to one another.

Advantageously, the system according to the invention moreover comprises at least one L-shaped corner piece suitable for reinforcing the connection between the first and second portions of a part or an S-shaped corner piece for reinforcing a connection between a longitudinal fold of a first portion of a part housed in the channel of an I-shaped beam with a solid beam.

The invention also relates to a construction or construction portion including at least two walls with a wooden framework including at least one solid wooden beam and an I-shaped wooden beam connected to the solid beam by means of a part according to the invention, said framework advantageously including two solid web wooden beams connected to one another at their ends respectively by an I-shaped wooden beam, parts according to the invention being used as connection means of said I-shaped wooden beams with said solid wooden beams, said walls being connected to one another by means of a system according to the invention connecting two beams of two adjacent walls.

Particular features and details of the invention will become apparent in the following detailed description of embodiments of the invention given only as example. In this description, reference is made to the appended drawings.

BRIEF DESCRIPTION OF THE DRAWINGS

In these drawings,

FIG. 2 is a front view of the part of FIG. 1,

FIG. 9A shows an exploded view of the part of FIG. 7 associated with a reinforcement corner piece, while FIG. 12 is a view of two walls in corner arrangement.

FIG. 26 shows an end of a series of U-shaped beams with intermediate reinforcements.

FIG. 27 is a perspective view of a further embodiment of a connection part or piece of the invention, suitable for a structure of the invention.

DESCRIPTION OF PREFERRED EMBODIMENTS OF THE INVENTION

Figure 1:
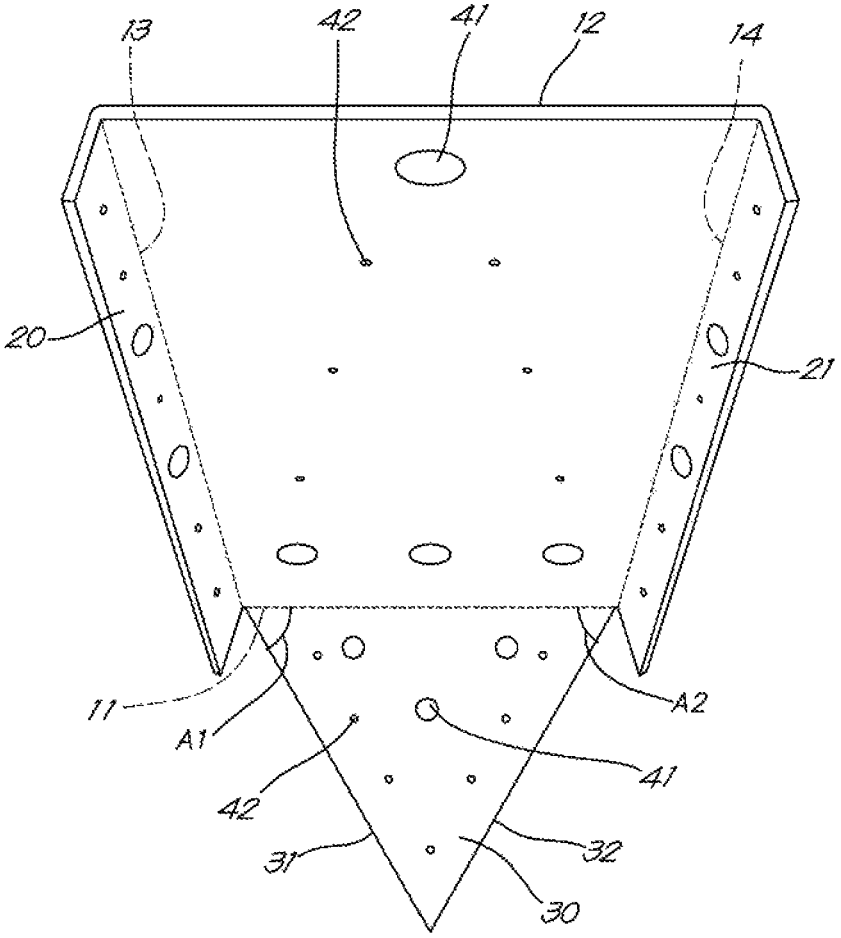
FIG. 1 is a perspective view of a part according to the invention.
Figure 9:
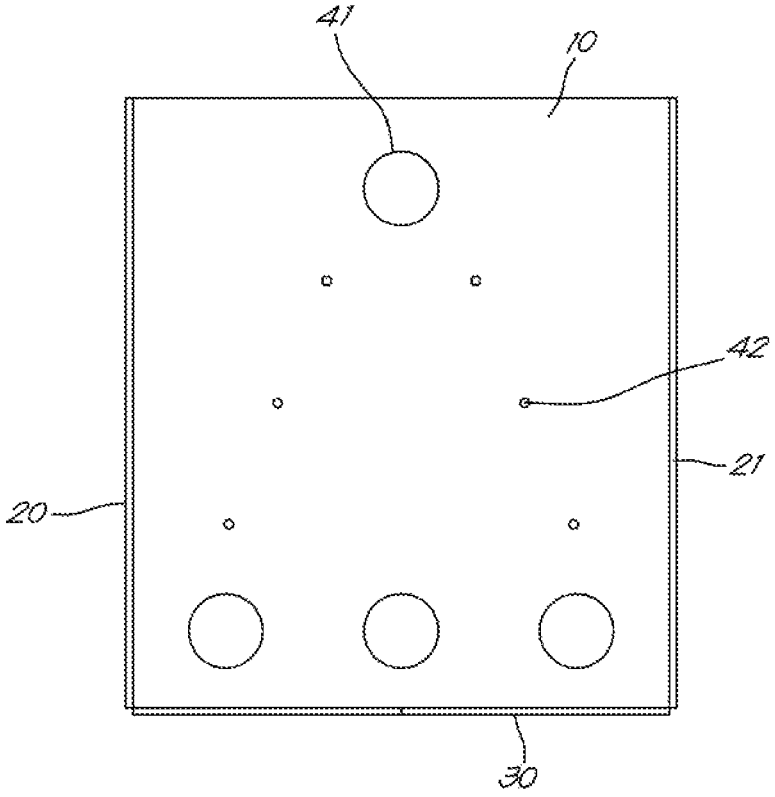

FIG. 1 shows a connection part (1) for a connection between, on the one hand, an I-shaped wooden beam in consideration (PI) including a central web (2) and two wings (3) defining two longitudinal channels (G1, G2) situated on either side of the central web (2), and, on the other hand, an element (E) selected from a base, a panel, a beam, in particular an I-shaped wooden beam.

Said part (1) is produced from a folded sheet made of metal, in particular made of steel, preferably of galvanized steel. The part (1) is fabricated by cutting a metal sheet with a thickness of 2 to 4 mm and is then folded to give the three-dimensional shape of the part. Said part (1) is suitable for cooperating with a channel (G1 or G2) of a predetermined I-shaped wooden beam (PI). The part (1) comprises:

A first substantially rectangular portion 10 having two lateral edges (11, 12) and two longitudinal edges (13, 14) that are spaced apart from one another by a distance corresponding substantially to the width of a channel (G1 or G2) of the I-shaped beam in consideration (PI), A first longitudinal reinforcement fold (20) lengthening the first portion along a first (13) of the longitudinal edges thereof (13, 14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) suitable so that, when the first portion (10) is supported on the bottom of the channel (G1 or G2) of the I-shaped beam in consideration (PI), the longitudinal folds (20, 21) extend in the volume defined by said channel (G1 or G2), and a second portion (30) lengthening the first portion (10) along one (11) of the lateral edges thereof (11, 12), said second portion (30) extending in a plane perpendicular to the plane in which the first portion (10) extends, said second portion (30) having a substantially trapezoidal or triangular shape with opposite lateral edges (31, 32) approaching one another the farther they get from said lateral edge (11) of the first portion, the second portion (30) moreover having a maximum length (LM), calculated starting from said lateral edge (11) of the first portion (10), which is at least equal to two times the maximum height (HM) of the longitudinal folds (20, 21).

The longitudinal folds (20, 21) extend in the spatial zone situated above the plane of the second portion (30) and including the first portion (10), while the lateral edges (31, 32) of the second portion (30) each form an angle (A1, A2) of less than 80° and advantageously of less than 75° with the lateral edge (11) of the first portion (10) from which the second portion (30) extends. In the embodiment, the second portion is in the shape of a substantially equilateral triangle.

Figure 4:
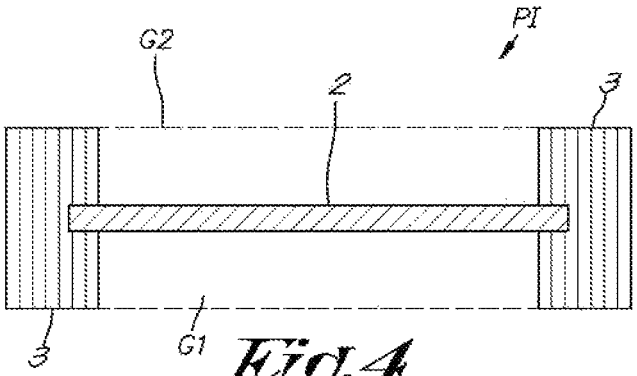
FIG. 4 is a cross-sectional view of an I-shaped wooden beam.
Figure 5:
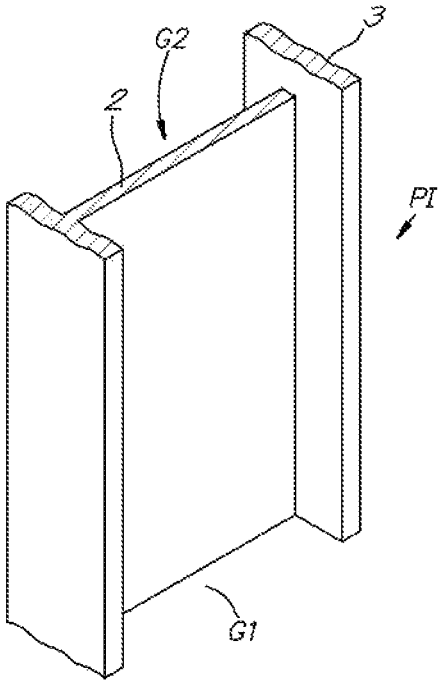
FIG. 5 is a partial perspective view of the beam of FIG. 4.

FIG. 4 is a cross section of an I-shaped wooden beam (PI). It consists of a web 2 (for example, made of a wooden fiber agglomerate and of a binder or glue) and of two wings 3 each produced by a stack of wooden sheets (for example, with a thickness of 1 to 2 mm (0.0393701 to 0.787402 inches)), said sheets being glued to one another by means of an adhesive layer. The stacks of sheets form a wing in which a groove is formed. The end or edge of the web 2 is then inserted in the groove with interposition of glue, in order to ensure that the wing is maintained in position with respect to the web 2. The wings 3 have, for example, a thickness of 1 to 4 cm (0.393701 to 1.5748 inches), while the web has a thickness of 2 to 5 cm (0.787402 to 1.9685 inches). On either side of the web 2, two channels G1, G2 are defined between the wings 3.

Figure 3A:
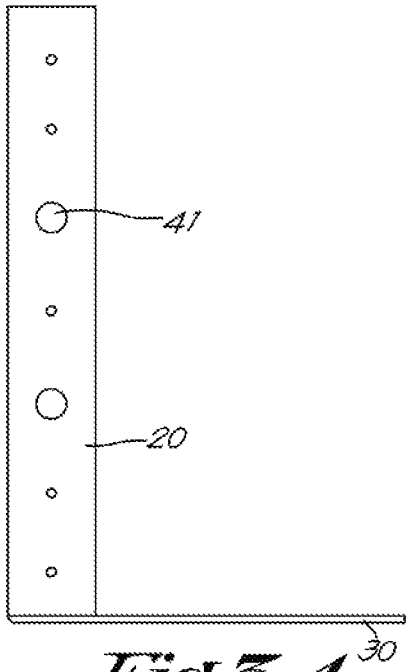
FIGS. 3A and 3B are side and top views, respectively, of the part of FIG. 1.
Figure 3B:
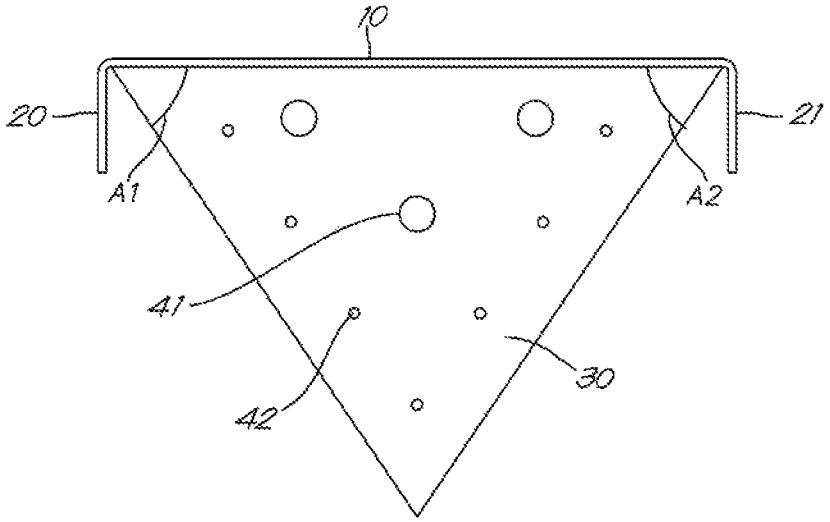

The part (1) represented in FIG. 1 (and in FIGS. 2, 3A and 3B) comprises a second portion (30) having a maximum length (LM), calculated starting from said lateral edge (11) of the first portion (10), which is at least equal to two to ten times (in particular 4 to 8 times) the maximum height (HM) of the longitudinal folds.

The first portion (10), the longitudinal reinforcement folds (20) and the second portion (30) have openings (41, 42) for the passage of fastening means (50). In fact, said portions and reinforcement have two types of substantially circular openings (41, 42) of different diameter.

The first and second portions (10, 30) and the longitudinal folds have first openings (41) suitable for allowing the passage of a shank of a bolt with a diameter of more than 5 mm, at least one first opening (41) of the second portion (30) of a part, of which the first portion (10) of the part in consideration is housed in the channel (G1 or G2) of an I-shaped wooden beam, being arranged so as to cooperate with a first opening (41) of the first portion (10) of a part similar to the part in consideration and which is housed in the channel (G1 or G2) of another I-shaped wooden beam (PI).

The longitudinal folds (20, 21) each advantageously have a height of less than 4 cm (1.5748 inches), in particular of 0.5 cm to 3.5 cm (0.19685 to 1.37795 inches), preferably of approximately 2 cm (0.787402 inches).

The second portion (30) has a maximum height (HM) between 0.5 and 1 times and in particular between 0.65 and 0.75 times the distance separating the longitudinal folds from one another, while the distance separating the longitudinal folds (21, 22) from one another is equal to 5 to 12 times the maximum height (HM) of the longitudinal folds (21, 22).

The lateral edges (11, 12) of the first portion (10) are spaced apart from one another by a distance equal to 1 to 2 times and advantageously 1.2 to 1.6 times the distance separating the longitudinal folds (21, 20) from one another.

Figure 6:
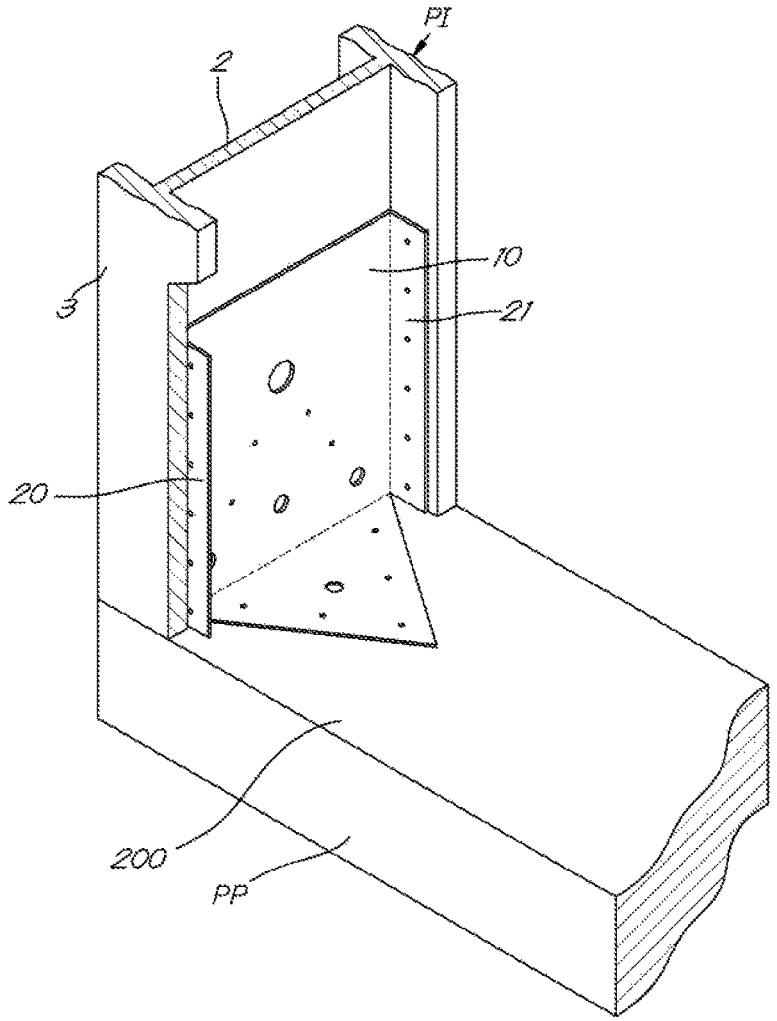
FIG. 6 shows the placement of a part in the channel of an I-shaped beam, with a solid beam.

FIG. 6 shows the placement of a part according to FIG. 1 for ensuring a connection between an I-shaped wooden beam PI and a solid web wooden beam PP. The first portion 10 of the part is supported on the web 2 of the beam PI, while the second triangular portion 30 rests on the face 200 of the solid web beam PP, on which face the end of the I-shaped beam (PI) is supported. The longitudinal folds 20, 21 are suitable for following the face of the wings 3 of the beam PI. In the embodiment, the longitudinal folds are not in contact with the face 200 of the solid web beam PP and are spaced apart from this face by a distance corresponding substantially to the thickness of the second portion 30.

Figure 7:
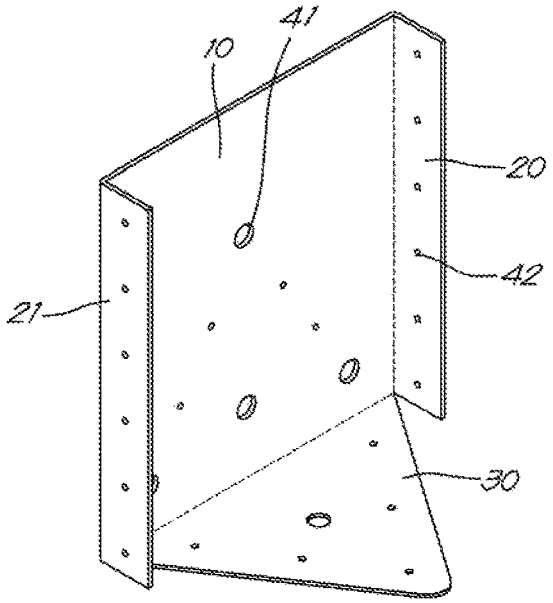
FIG. 7 is a perspective view of another embodiment of a part according to the invention.

The embodiment of FIG. 7 is similar to the embodiment of FIG. 1, except that the corners are rounded.

Figure 8:
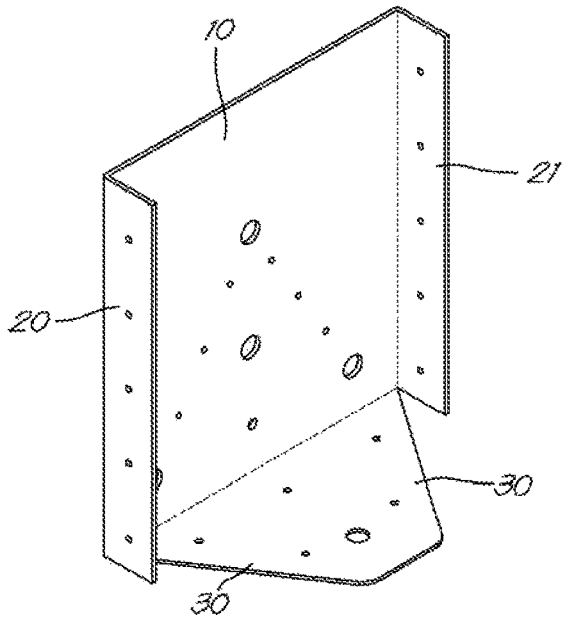
FIG. 8 is a perspective view of yet another embodiment according to the invention.

The embodiment of FIG. 8 is similar to the embodiment of FIG. 7, except that the second portion 30 has a substantially trapezoidal shape.

Figure 9A:
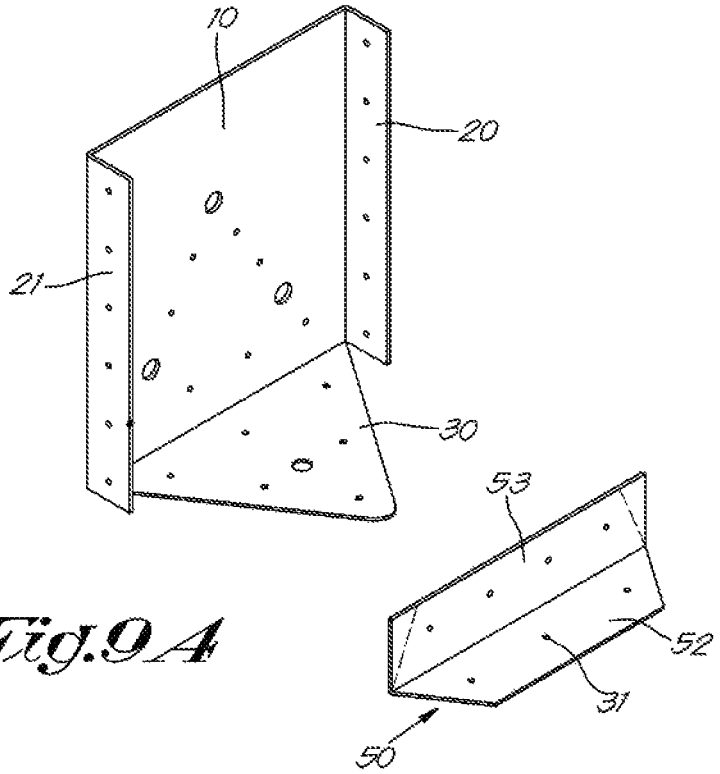
Figure 9B:
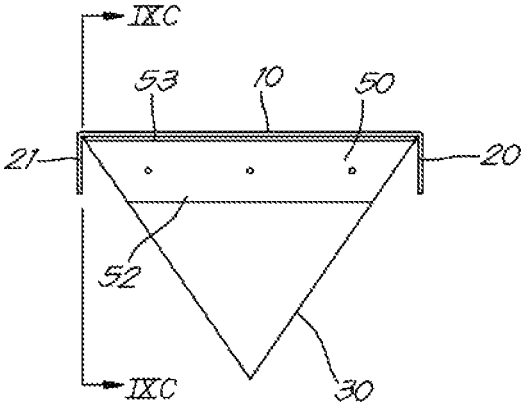
FIGS. 9B and 9C are top and side views (with partial cutaway of a longitudinal fold) of the part associated with the reinforcement corner piece.
Figure 9C:
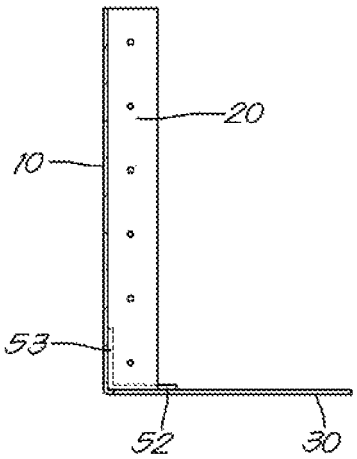

FIG. 9A shows in an exploded view the part of FIG. 7 associated with a L-shaped corner piece 50, the two wings 52, 53 of which have openings 51. The wing 53 is substantially rectangular with a width corresponding substantially to (although smaller than) the distance separating the two longitudinal folds 20, 21. The wing 52 has a trapezoidal shape with a height at least equal to the height of the longitudinal folds. The wings 52, 53 extend in planes forming a 90° angle between them.

The trapezoidal shape of the wing 52 is advantageously suitable so that the non-parallel edges thereof substantially match the lateral edges of the second portion. The wing 52 has at least openings 51 suitable for extending into the opening extension of the second portion.

In a possible embodiment, the wing 53 has a trapezoidal shape (shown with broken lines) in such a manner as to make it possible to use the corner piece in two different ways. This corner piece makes it possible to reinforce the part 1 at the edge thereof 11, while allowing a certain movement of the longitudinal folds 20, 21 with respect to the first portion 10, and even in the case of movement between the portions 10, 30, for example, in the case of large forces.

Figure 10:
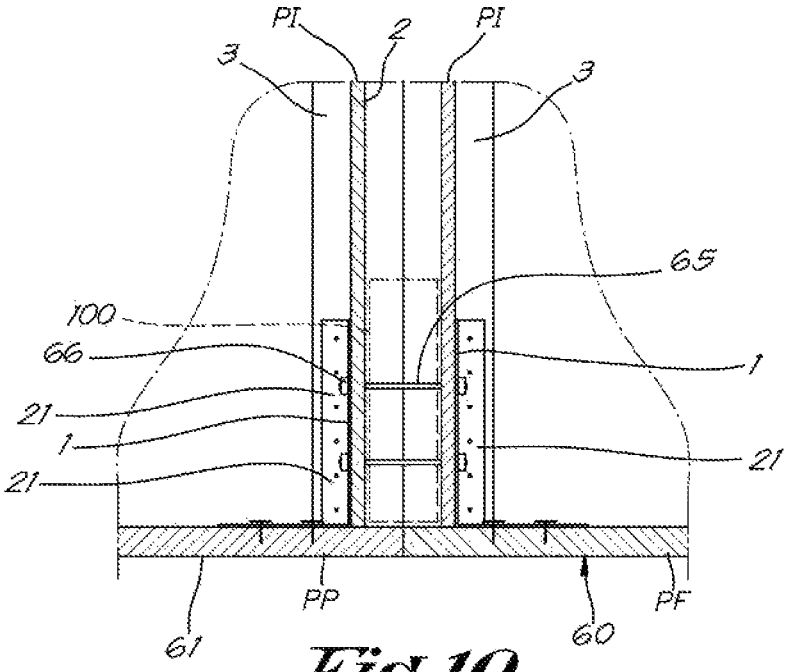
FIG. 10 shows a cross section of the connection of two adjacent I-shaped wooden beams by means of a system according to the invention (after cutaway of a wing of the beams and of a longitudinal fold of the part)

FIG. 10 diagrammatically shows the connection of two I-shaped wooden beams to one another, for example, of two separate adjacent walls 60, 61. A first part 1 is associated with the beams PI of the wall 60 in the manner shown in FIG. 6. A second part 1 is associated with the beams PI of the wall 61 in the manner indicated in FIG. 6. By perforating the webs of the vertical beams in the extension of the openings 41 of large diameter, it is possible to insert the shank 65 of bolts through the two webs 2 and through the openings 41. By means of a nut 66, it is then possible to rigidly connect the two I-shaped beams to one another. By ensuring points of attachment of the longitudinal folds 20, 21 to the wings, the force generated by the bolts is transmitted to the wings which are supported on one another. Advantageously, a piece of solid web wooden beam 100 is placed between the webs 2 of the two I-shaped beams (PI) in order to absorb compressive forces.

Figure 11:
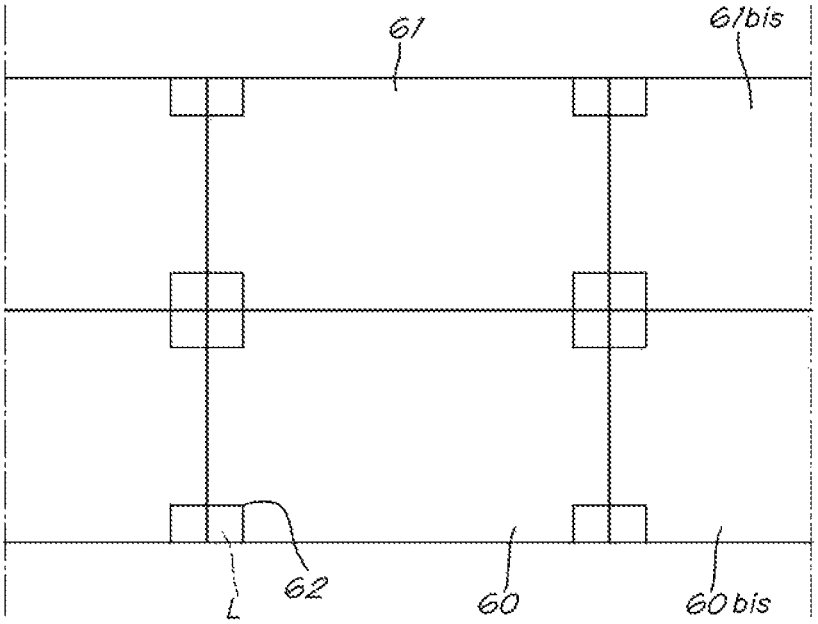
FIG. 11 shows a series of walls connected to one another by systems according to the invention.

FIG. 11 shows a series of walls 60, 61 connected to one another by means of systems as represented in FIG. 10. Each wall 60, 61 has an internal framework closed by a front partition and a rear partition. At each corner of the wall, a recess L is accessible by opening or by removing a door 62. Each recess is intended to receive a part according to the invention in order to ensure a fastening of the walls to one another or to an anchoring sill on the floor. Since the access to the recesses is easily accessible, it is possible to easily dismantle and remove a part, and thus to dismantle one or more walls. This also makes it possible to easily check the fastenings over time, namely after an earthquake. The walls 60, 61 can be placed between them to form a corner of a dwelling. (see FIG. 12 with cutaway of the front face in order to make it possible to see the internal framework)

Figure 13:
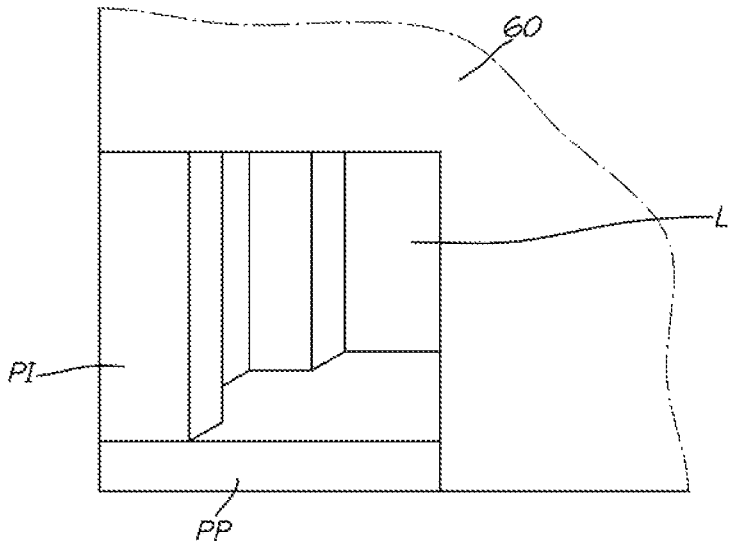
FIG. 13 is a detail view of a corner of a wall.

FIG. 13 shows in a perspective view a recess L after removal of the beam 62. This recess gives access to the lower portion of the I-shaped beam situated to the right of the wall and to the portion of the adjacent lower I-shaped beam, this then making it possible to fasten the wall either to a wall situated to the left and/or to a wall situated below the wall in consideration.

Figure 14:
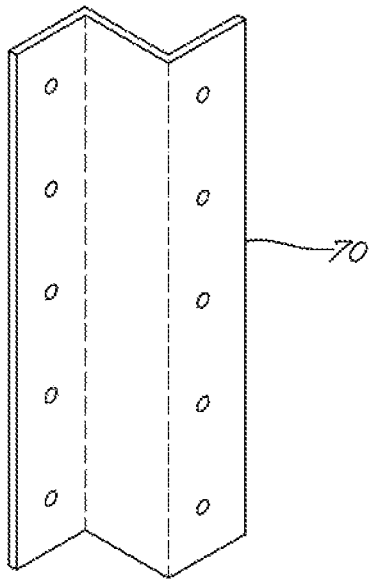
FIG. 14 is a partial perspective view showing another reinforcement part.

FIG. 14 is a view of another reinforcement part 70 which has an S-shaped or Z-shaped cross section.

Figure 15:
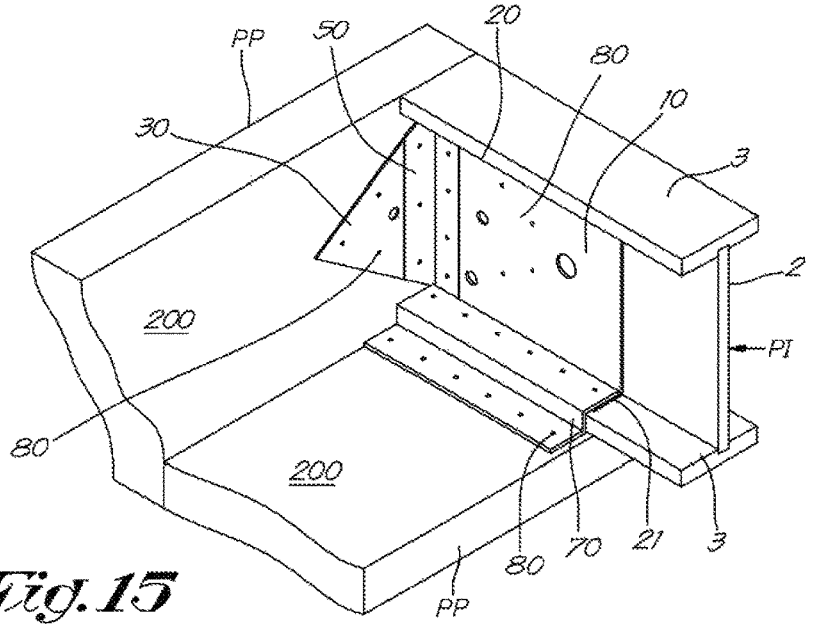
FIG. 15 is a view of parts according to the invention associated with one another.

FIG. 15 shows a part 1 associated with a reinforcement part 50 and a reinforcement part 70, for the connection of an I-shaped beam with two solid web beams PP by means of bolts 80. Other associations are possible, as needed.

Figure 16:
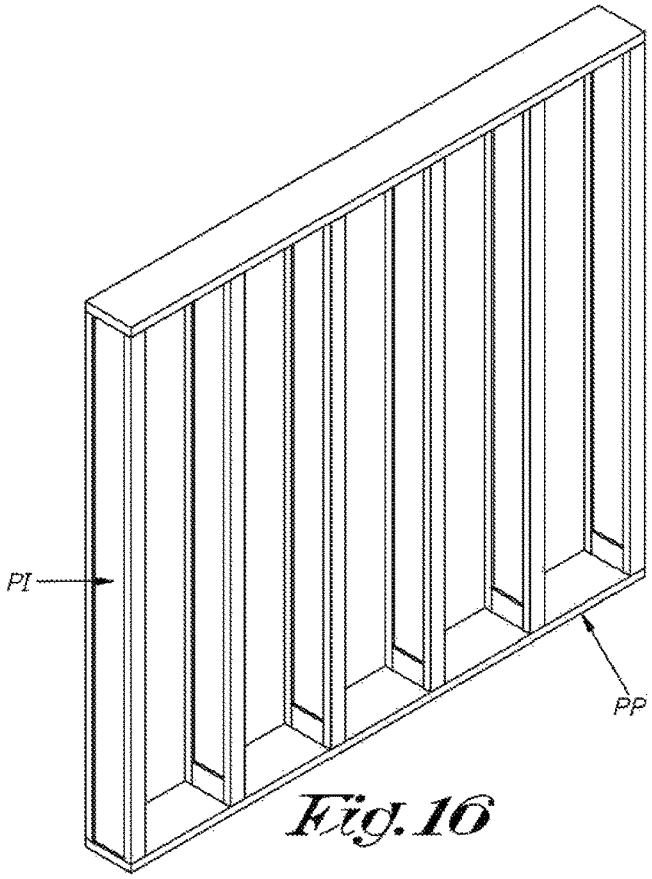
FIG. 16 shows a framework of a wall.

FIG. 16 shows in a perspective view an internal framework of a wall consisting of a series of I-shaped wooden beams (PI) extending between two solid web beams PP.

Figure 17:
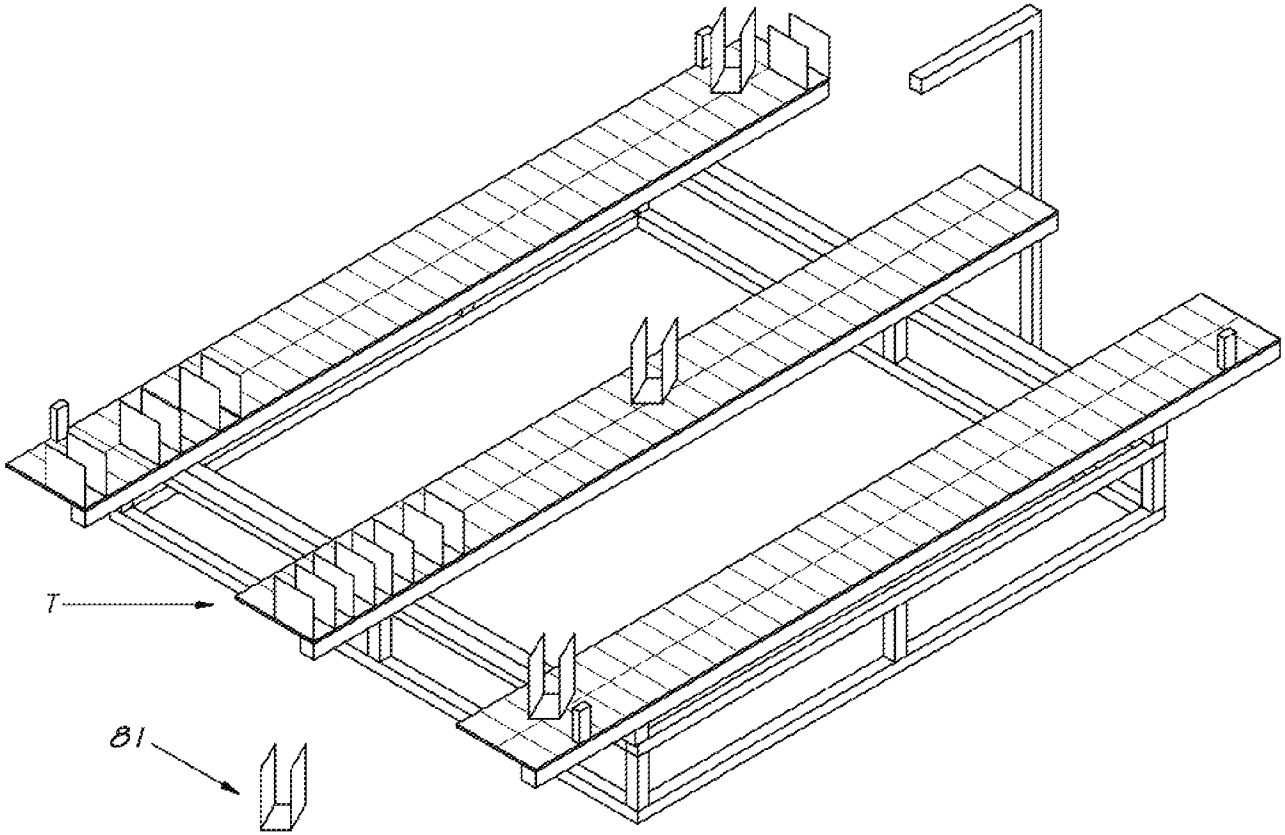
FIG. 17 shows a table for the production of a framework according to FIG. 16.

FIG. 17 is a diagrammatic view of a table T for the production of a framework for a wall (as represented in FIG. 16). This table allows a correct positioning of the I-shaped beams during their securing. This table comprises colored travelers 81, so that the operator cannot make mistakes during the placement of the I-shaped beams to be assembled to one another. This then makes it possible to mount the frameworks at the construction site itself, since the risk of making mistakes is low, or zero.

Figure 18:
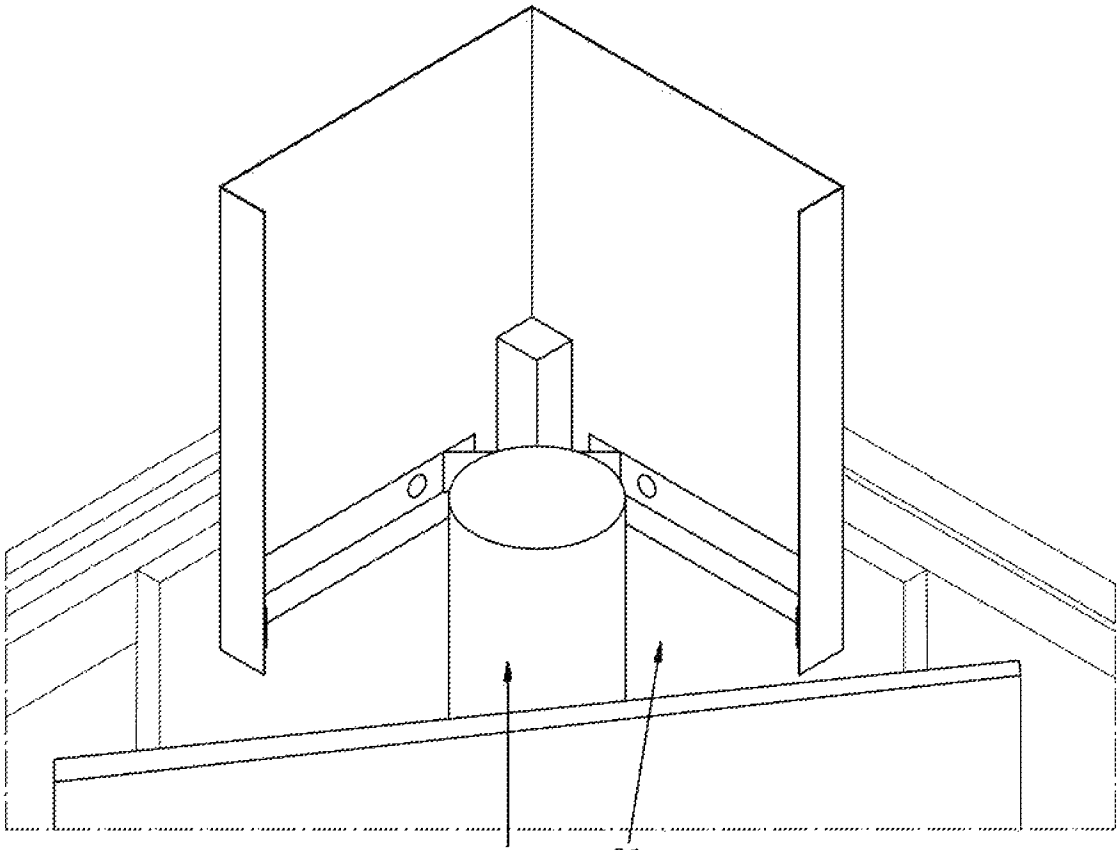
FIG. 18 shows a detail of a construction according to the invention.
Figure 19:
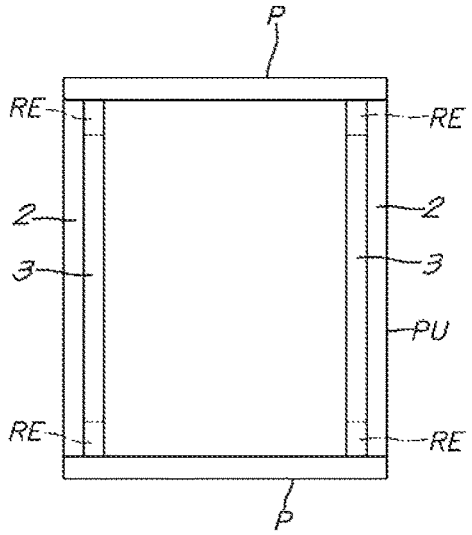

FIG. 18 shows the corner of two walls connected to one another. It is possible, as represented in FIG. 18, to create easily accessible technical rooms 90 for pipes 91, downpipes, wires, etc. By placing these technical rooms in the corners, it is possible to keep the panel housings open in order to form passages between the interior of a panel and a technical room.

Figure 19:
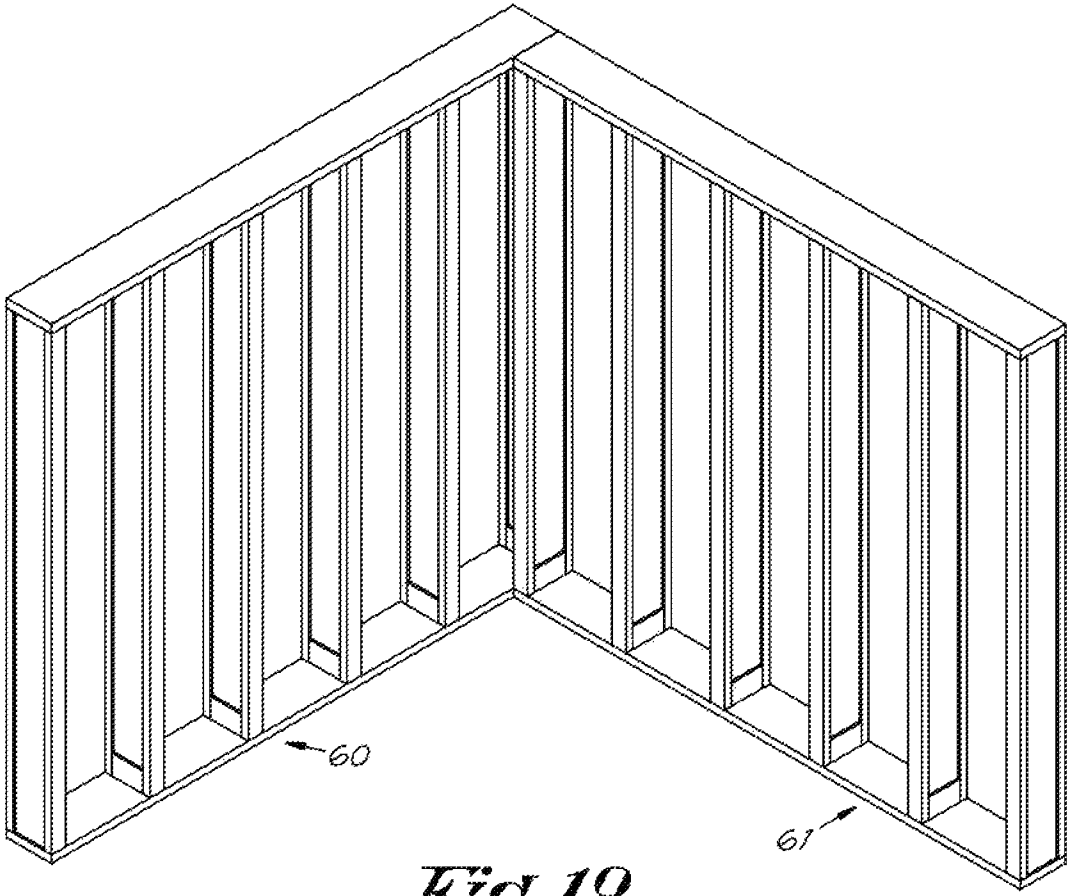
FIG. 19 diagrammatically shows a rectangular structure according to the invention including four beams.

FIG. 19 diagrammatically shows a rectangular structure according to the invention including four beams, namely two simple horizontal wooden beams P (for example, made of pressed wood) and two vertical U-shaped beams (PU) with intermediate reinforcement at the ends (RE). The longitudinal wings 3 are glued to the web 2 of the beams PU. This structure thus forms a frame capable of supporting one or more panels and of which the internal volume can contain one or more insulating elements, one or more service shafts, etc. Additional vertical beams PU can be used to connect the beams P.

Figure 21:
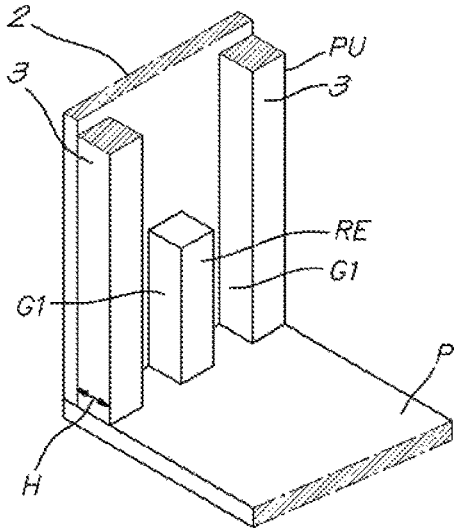
FIG. 21 is a partial perspective view of two beams placed at right angles, before the use of two connection parts.
Figure 22:
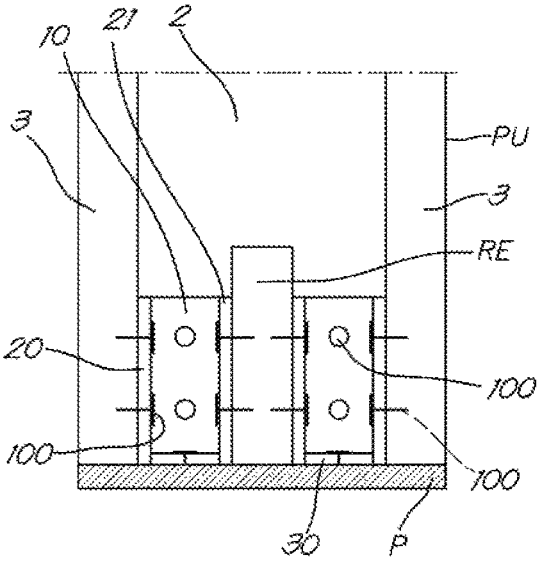
FIG. 22 is a partial cross-sectional view of the beams of FIG. 21, attached to one another by two connection parts.

FIGS. 21 and 22 show in further detail the connection of a beam PU to a beam P.

As can be seen in FIG. 21, the end of the beam PU with reinforcement RE extends in the same horizontal plane, which facilitates a correct positioning at right angles of the beam PU with respect to the beam P.

At the end of the beam PU, two channels G1, G1' are defined, a first between a first wing 3 and the reinforcement, and a second between the second wing and the reinforcement RE. These channels G1, G1' advantageously have an identical shape in order to receive the same type of connection part. The central axes (vertical in the present case) of the channels G1, G1' are parallel to one another. The reinforcement RE has, for example, a length of 10 to 50 cm, and a height H corresponding to the height of the wings 3. The reinforcements of the ends of the beam PU thus do not form a whole or a single part. These reinforcements are advantageously glued to the web of the beam (2).

In FIG. 21, the connection parts have not been represented.

For the fastening of the beam PU to the beam P, two connection parts are used, a first being introduced into the channel G1, the second being introduced into the channel G1'.

Each metal connection part comprises:

A first substantially rectangular portion 10 having two lateral edges and two longitudinal edges which are spaced apart from one another by a distance corresponding substantially to the width of a longitudinal channel (G1 or G1') of the U-shaped beam with intermediate reinforcement in consideration (PU), A first longitudinal reinforcement fold (20) lengthening the first portion along a first of the longitudinal edges thereof and a second longitudinal reinforcement fold (21) lengthening the first portion (10) along the second of the longitudinal edges, said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) suitable so that, when the first portion (10) is supported on the bottom of the channel (G1 or G1', thus on a face of the web 2 of the beam PU bearing the wings 3 and the reinforcement RE) of the beam PU in consideration, the longitudinal folds (20, 21) extend in the volume defined by said channel (G1 or G1') or respectively come in contact with a face of a wing and a face of the reinforcement RE (parallel opposite faces of the channel G1 or G1'), and A second portion (30) lengthening the first portion (10) along one of the lateral edges thereof, said second portion (30) extending in a plane perpendicular to the plane in which the first portion (10) extends, the second portion (30) moreover having a maximum length (LM), calculated starting from said lateral edge of the first portion (10), which is at least equal to 1.2 times (in the present case 1.5 to 2 times) the maximum height (HM) of the longitudinal folds (20, 21) (in such a manner that the free edge of the portion 30 which is supported on the face of the beam P extends outside of the volume of the channel G1 or G1' in consideration).

The connection part is fastened by means of screws or nails 100.

Figure 20:
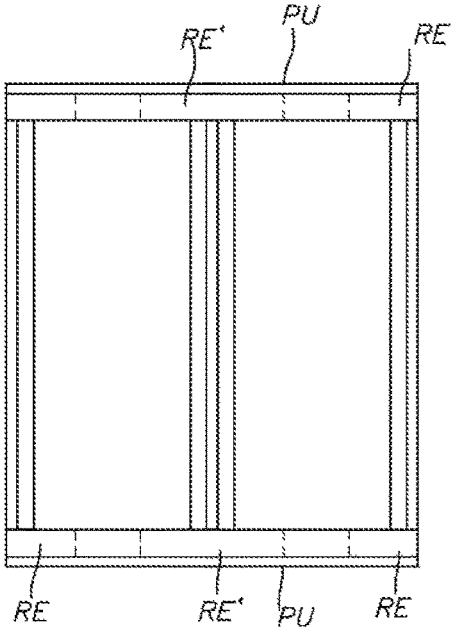
FIG. 20 diagrammatically shows another rectangular structure according to the invention, including four beams defining the external frame and an intermediate beam.

FIG. 20 is a view of a structure similar to that of FIG. 19, except that the horizontal beams are U-shaped beams with intermediate reinforcements (RE) at the ends of the beams PU and with one or more additional reinforcements RE' separate from the reinforcements RE situated between the reinforcements RE; and except that one or more I-shaped beams with reinforcements RE" is/are used between the horizontal beams PU.

Figure 23:
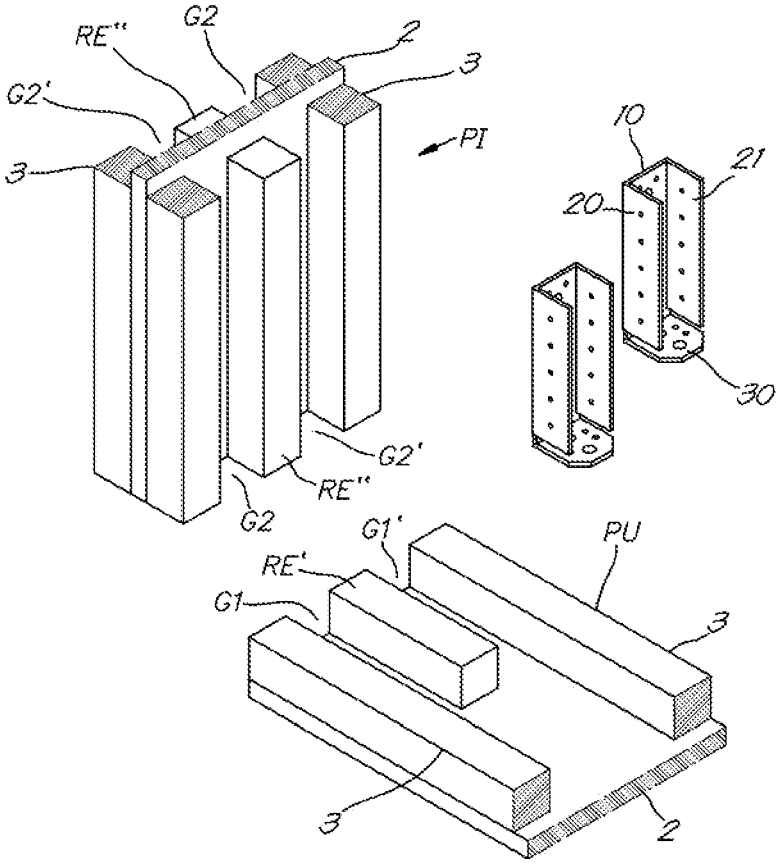
FIG. 23 is a partial (exploded) perspective view showing an I-shaped beam with reinforcements, attached to an E-shaped beam (or a U-shaped beam with intermediate reinforcements)
Figure 24:
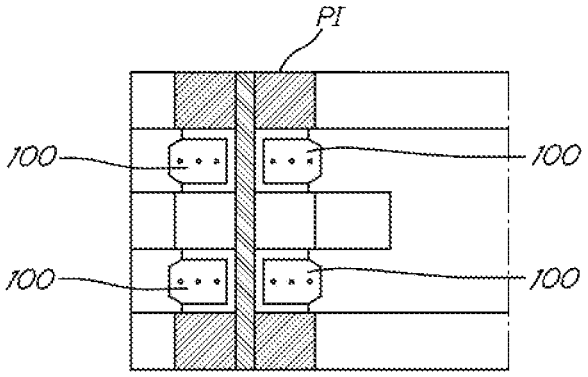
FIG. 24 is a cross-sectional view showing the connection of an I-shaped beam with reinforcement to a U-shaped beam with intermediate reinforcement.

FIGS. 23 and 24 show the fastening of an I-shaped beam (PI) on a U-shaped beam with reinforcement (PU). The lower face of the reinforcements RE" is supported on the reinforcement RE' of the beam PU, while the wings 3 of the beam PI are supported on the wings of the beam PU. The channels G1, G1' of the beam PU have a shape identical to the channels G2, G2' of the beam PI, so that connection parts of the same type can be used for securing the beams to one another.

The portion 30 of the connection part is supported on a face of the web 2 of the beam PU, while the portion 10 is supported on a face of the web 2 of the I-shaped beam. A portion of the portion 10 extends simultaneously in a channel G1, G1' of the U-shaped beam PU and in a channel G2, G2' of the beam PI. The folds 20, 21 of the connection part are supported on the opposite lateral faces of a channel G1, G1' and on the opposite lateral faces of a channel G2, G2'.

The I-shaped beam with reinforcement can thus be fastened to a beam P, PI by means of four connection parts.

Figure 25:
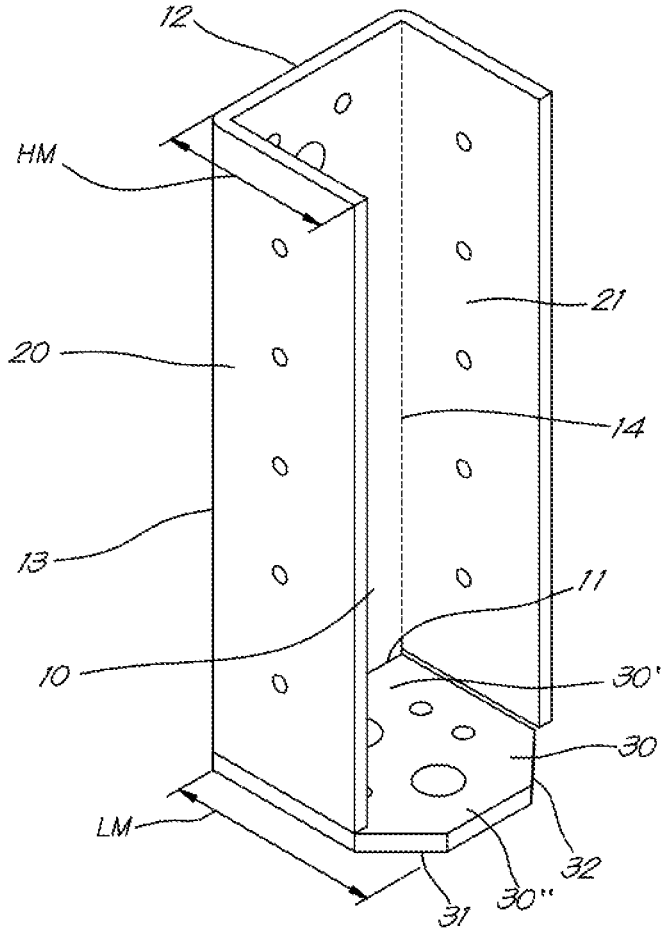
FIG. 25 is a perspective view of a connection part according to the invention.
Figure 97:
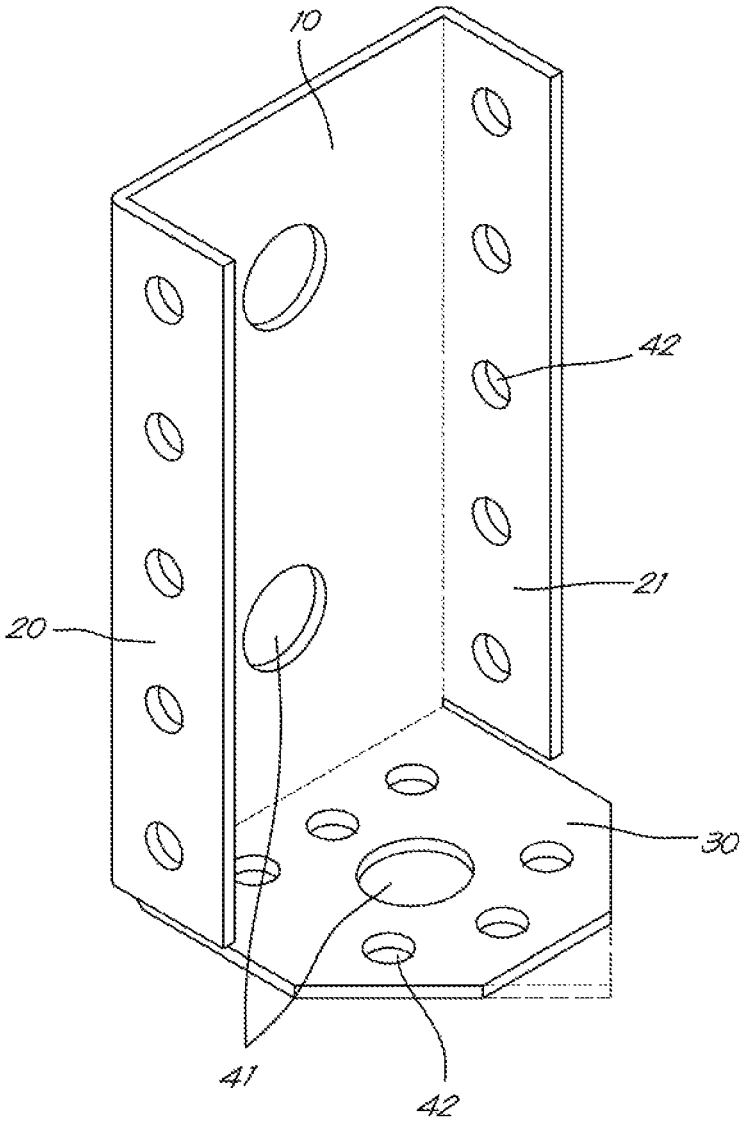

FIG. 25 is a perspective view of an advantageous metal connection part.

Said metal connection part, obtained by folding and cutting of a metal sheet, advantageously made of steel, comprises:

a first substantially rectangular portion 10 having two lateral edges (11, 12) and two longitudinal edges (13, 14) which are spaced apart from one another by a distance corresponding substantially to the width of a longitudinal channel (G1 or G2) of the I-shaped or U-shaped beam in consideration (PI, PU), a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on the same side with respect to the plane in which the first portion (10) extends, said longitudinal folds (20, 21) having a maximum height (HM) suitable so that, when the first portion (10) is supported on the bottom of the channel (G1 or G2) of the I-shaped or U-shaped beam in consideration (PI, PU), the longitudinal folds (20, 21) extend in the volume defined by said channel (G1 or G2), and a second portion (30) lengthening the first portion (10) along one (11) of the lateral edges thereof (11, 12), said second portion (30) extending in a plane perpendicular to the plane in which the first portion (10) extends, the second portion (30) moreover having a maximum length (LM), calculated starting from said lateral edge (11) of the first portion (10), which is at least equal to 1.2 to 2 times the maximum height (HM) of the longitudinal folds (20, 21).

Said second portion (30) has a shape or section of substantially trapezoidal shape with opposite lateral edges (31, 32) that approach one another the farther they get from said lateral edge (11) of the first portion. In particular, the portion 30 comprises a first section of substantially rectangular shape lengthened by a section of substantially trapezoidal shape, the trapezoidal section 30" having a free edge situated at a distance LM which is greater than the height HM of the folds, while the rectangular section 30' is situated in a zone at a distance of less than 0.9 times the height HM from the edge 11. has a substantially trapezoidal or triangular shape with opposite lateral edges (31, 32) that approach one another the farther they get from said lateral edge (11) of the first portion.

Said second portion (30) has a substantially trapezoidal shape with opposite lateral edges (31, 32) that approach one another the farther they get from said lateral edge (11) of the first portion.

The lateral edges (31, 32) of the trapezoidal section 30" of the second portion (30) each form an angle (A1, A2) of less than 80° and advantageously of less than 75° with the lateral edge (11) of the first portion (10) from which the second portion (30) extends.

The metal connection part is produced by cutting, perforation of holes and folding of a metal sheet made of steel having a thickness of 2 to 4 mm (0.0787402 to 0.15748 inches).

FIG. 26 shows a face of a series of ends of U-shaped or I-shaped beams with reinforcements RE, said reinforcements RE being produced, for example, by juxtaposition of a series of separate elements.

FIG. 27 is a view of a connection part similar to that shown in FIG. 25, except that the longitudinal wings 20,21 have a smaller height. The second portion is a combination of a rectangular portion and an end triangular portion. The end triangular portion can be a triangle shaped portion or only a part thereof (for example a triangle without the end tip).

Figure 28:
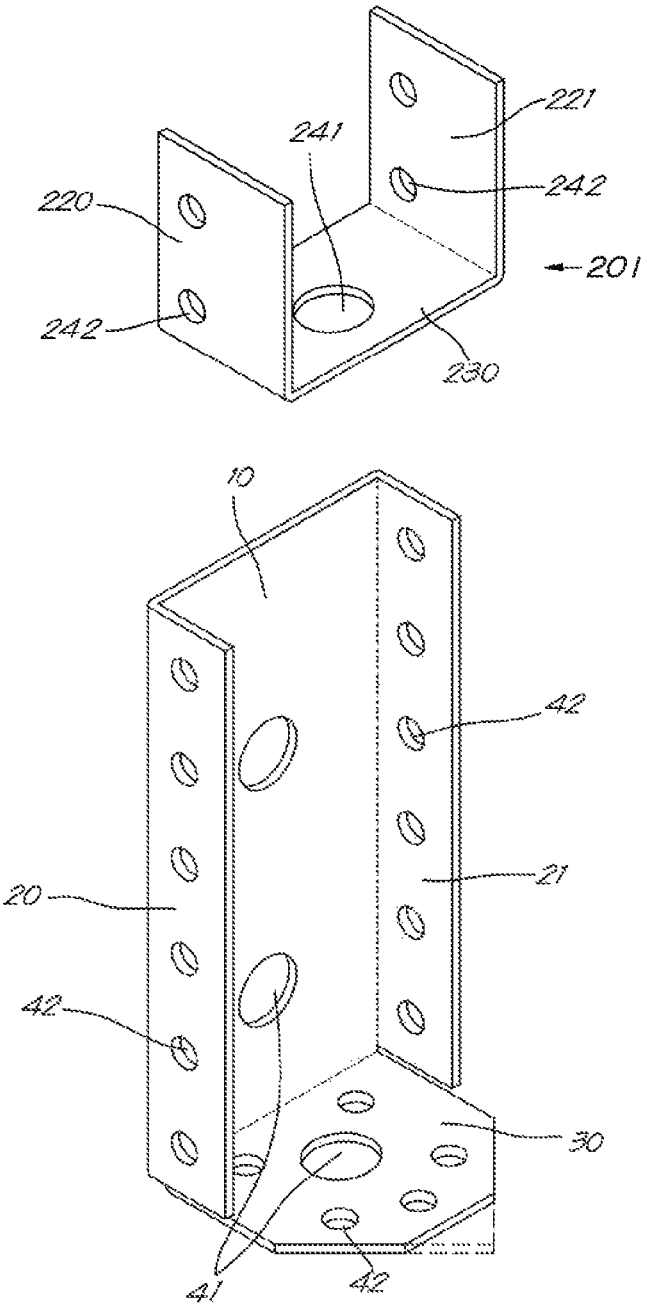
FIG. 28 is an exploded perspective view of a further embodiment of a connection part of the invention associated to a U-shaped reinforcement piece.

In FIG. 28, the connection part is similar to that shown in FIG. 27, but is associated to a U-shaped profile 201 acting as reinforcement piece. The U-shaped reinforcement profile is intended to be placed between the wings 20,21 of the connection part. The profile has two lateral wings 220,221 attached to a central web 230. Said U profile is formed by folding a metal plate with a thickness of 2 to 6 mm. The wings 220, 221 are provided with openings 242 adapted to extend in front of openings 42, when the web 230 of the U profile contacts the second portion 30 of the connecting part. The web 230 is provided with an opening 241 adapted to extend in front of opening 41 of the second portion 30, whereby a stem of bolt can extend through the said openings 41 and 241.

Figure 29:
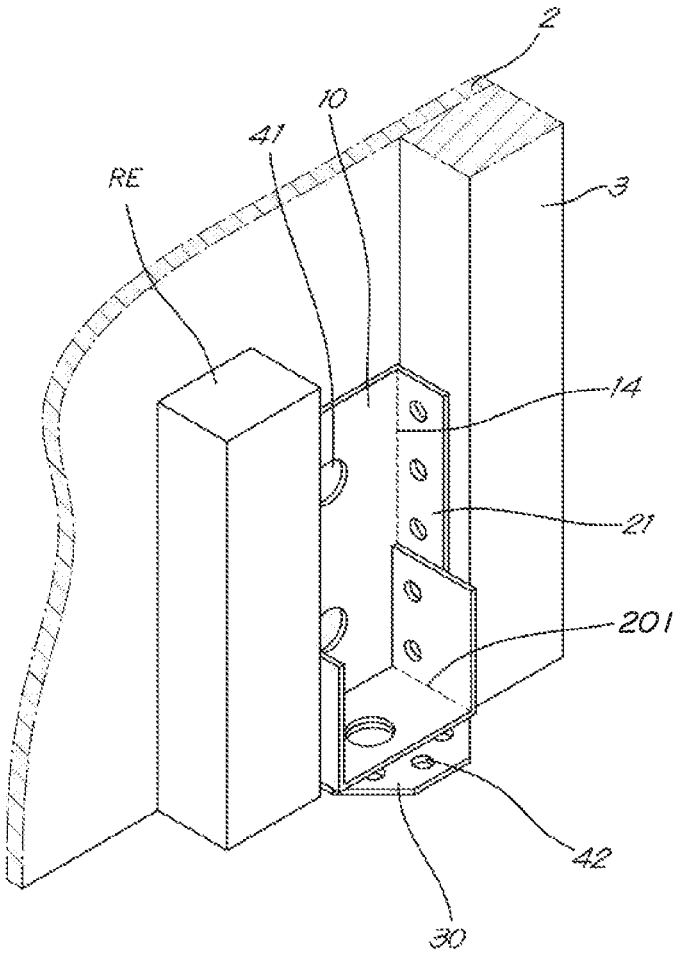
FIG. 29 is a view of the connection part of FIG. 28 placed within a channel formed between the wooden reinforcement RE and a wooden wing 3

In FIG. 29, the placement of the connection part and reinforcement profile 201 in a channel (defined between a reinforcement RE and a wing 3) is shown.

According to possible embodiments, the first and/or second longitudinal reinforcement fold (20,21) are connected to the second portion (30) by one or more welding points or lines.

The invention claimed is:

1. A structure comprising at least four wooden beams each comprising a wooden web, said beams being attached to one another so as to define at least one substantially rectangular frame, in which at least two of said four beams defining a substantially rectangular frame are I-shaped or U-shaped wooden beams, each I-shaped or U-shaped beam including at least (a) a planar central wooden web (2) having two opposite faces, a first longitudinal edge, a second longitudinal edge opposite to the first longitudinal edge, a first lateral end edge and a second lateral end edge opposite to the first lateral end edge, (b) a first longitudinal wooden wing (3) extending along the first longitudinal edge, (c) a second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, whereby said at least first longitudinal wooden wing and second longitudinal wooden wing (3) are attached to said planar central wooden web (2) while defining, between said at least first longitudinal wing and second longitudinal wing (3), at least one longitudinal channel (G1,G2) with a bottom extending along the planar central wooden web and with two opposite faces extending from the said bottom, said opposite faces of a considered channel being distant the one to the other by a distance defining the width of the considered channel and defining therebetween a channel volume, whereby said at least four wooden beams defining the substantially rectangular frame are attached to one another by means of at least one metal connection part (1) and fixation means connecting the said at least one metal connection part to wooden beams of said at least four wooden beams defining the substantially rectangular frame, said at least one connection metal part being formed by folding a metal plate element, whereby each of said at least one metal connection part (1) has at least a first flat being supported on one of the opposite faces of a considered longitudinal channel (G1,G2) of a considered I-shaped or U-shaped beam (PU,PI), a second flat being supported on the other of said opposite faces of the considered longitudinal channel (G1, G2) of said considered I-shaped or U-shaped beam (PU, PI) and at least one third flat that is supported at least on the central wooden web (2) of another beam (P) connected to said considered I-shaped or U-shaped beam (PU,PI), said metal connection part positioned between a respective U-shaped or I-shaped beam (PU, PI) and another said beam comprising:

a first substantially rectangular portion (10) having two lateral end edges (11, 12) and two longitudinal edges (13, 14) which are spaced apart from one another by a distance corresponding substantially to the width of the longitudinal channel (G1, G2) of the I-shaped or U-shaped beam in consideration (PI, PU), a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on a same side with respect to the plane in which the first portion (10) extends, said first and second longitudinal reinforcement folds (20, 21) having a maximum height (HM) measured from the first portion (10), said maximum height being adapted so that, when the first portion (10) is supported on the bottom of the considered channel (G1, G2) of the I-shaped or U-shaped beam in consideration (PI, PU), the longitudinal reinforcement folds (20, 21) extend in the channel volume defined by said considered channel (G1, G2) and are the first flat (20) and the second flat (21) contacting the opposite faces of the considered channel (G1,G2), and a second portion (30) lengthening the first portion (10) along one (11) of the lateral end edges thereof (11, 12), said second portion (30) extending in a plane substantially perpendicular to the plane in which the first portion (10) extends, the said second portion (30) having a maximum length (LM), calculated starting from said one lateral end edge (11) of the first portion (10), which is at least equal to 1.2 times the maximum height (HM) of the said first and second longitudinal reinforcement folds (20, 21), wherein the first portion (10), the first longitudinal reinforcement fold (20), the second longitudinal reinforcement fold (21) and the second portion (30) of said metal connection part are provided with openings (41,42) cooperating with said fixation means (50).

2. The structure of claim 1, in which the first longitudinal wing and the second longitudinal wing each comprise a series of wooden sheets glued one another.

3. The structure of claim 1, in which at least two of said four beams defining a substantially rectangular frame are I-shaped or U-shaped wooden beams, each I-shaped or U-shaped beam further including at least one longitudinal intermediate wooden reinforcement situated between said two longitudinal wooden wings (3), said at least two longitudinal wooden wings (3) and the reinforcement(s) being attached to said planar central web (2) in such a manner as to define, between said two longitudinal wings (3) and the reinforcement, at least two distinct longitudinal channels (G1, G2).

4. The structure according to claim 1, wherein said four beams are at least four I-shaped or U-shaped wooden beams defining the substantially rectangular frame, each said I-shaped or U-shaped beam including the planar central wooden web (2) having the two opposite faces, the first longitudinal edge, the second longitudinal edge opposite to the first longitudinal edge, the first lateral end edge and the second lateral end edge opposite to the said first lateral end edges, at least (a) the first longitudinal wooden wing (3) comprising a first series of wooden sheets glued one another, said first longitudinal wooden wing (3) extending along the first longitudinal edge, (b) the second longitudinal wooden wing (3) comprising a second series of wooden sheets glued one another, said second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, and, whereby said at least first longitudinal wooden wing and second longitudinal wooden wing (3) are attached to said planar central web (2), while defining between said at least first longitudinal wooden wing and second longitudinal wooden wing (3), said at least one longitudinal channel (G1,G2) with the bottom extending along the planar central wooden web and with two opposite faces extending from the said bottom, said opposite faces of the considered channel being distant the one to the other by the distance defining the width of the considered channel and defining therebetween the channel volume, whereby said at least four I-shaped or U-shaped wooden beams are attached to one another by means of said at least one metal connection part (1) and said fixation means connecting said at least one metal connection part to said wooden beams of said at least four wooden beams defining the substantially rectangular frame, said at least one connection metal part being formed by folding the metal plate element, whereby each of the said at least one metal connection part connecting a first beam of said four I-shaped or U-shaped beams defining the substantially rectangular frame to a second beam of said four I-shaped or U-shaped beams defining the substantially rectangular frame has said at least first flat (20) being supported on one of the opposite faces of the considered channel (G1,G2) of the first beam, as well on one of the opposite faces of the considered channel of the said second beam, and said second flat (21) being supported on the other of the opposite faces of the considered channel (G1,G2) of the first beam, as well on the other of the opposite faces of the considered channel of the said second beam.

5. The structure according to claim 1, in which the planar central wooden web (2) of the I-shaped or U-shaped beams of the substantially rectangular frame extends each within a plane, and in which the wings (3) of one of the said I-shaped or U-shaped beams of the substantially rectangular frame comprises a series of glued wooden sheets selected among the group consisting of a series of wooden sheets extending each in a plane parallel to the plane of the planar central wooden web (2), a series of wooden sheets extending each in a plane perpendicular to the plane of the planar central wooden web, and combination thereof.

6. The structure according to claim 3, in which the longitudinal intermediate wooden reinforcements have a length of 20 to 50 cm (7.87402 to 19.685 inches).

7. The structure according to claim 1, in which each of the at least one connection part (1) connecting the one beam to another beam of the said four beams defining the substantially rectangular frame defines a spatial zone with a first face extending along the first portion (10) and with a second face extending along the second portion, whereby the first longitudinal fold (20) and the second longitudinal fold (21) extend in the said spatial zone of the said considered connection part.

8. The structure according to claim 1, in which said second portion (30) has a shape or section of substantially trapezoidal or triangular shape with opposite first and second lateral edges (31, 32) that approach one another the farther the opposite first and second lateral edges (31, 32) from said lateral edge (11) of the first portion (10).

9. The structure according to claim 8, in which the first and second lateral edges (31, 32) of the second portion (30) have each at least an inclined edge portion, the said inclined edge portion of the first lateral edge and the said inclined portion of the second lateral edge extend along lines forming an angle (A1, A2) of less than 85° with the lateral edge (11) of the first portion (10) from which the said second portion (30) extends.

10. The structure according to claim 8, in which, the second portion (30) lengthening the first portion (10) along one (11) of the lateral edges thereof (11,12) extends in a plane perpendicular to the plane in which the first portion (10) extends, the second portion (30) having a maximum length (LM), calculated starting from said lateral edge (11) of the first portion (10), which is at least equal to two times the maximum height (HM) of the longitudinal folds (20, 21).

11. The structure according to claim 10, in which the second portion (30) has a maximum length (LM), calculated starting from said lateral edge (11) of the first portion (10), which is 1.5 times to 10 times the maximum height (HM) of the longitudinal folds (20,21).

12. The structure according to claim 1, in which said second portion (30) has a shape or section of substantially triangular shape with opposite first and second lateral edges (31, 32) that approach one another the farther the opposite first and second lateral edges (31, 32) from said lateral edge (11) of the first portion (10), and in which the second portion (30) has a substantially triangular shape, the lateral edges (31, 32) of the second portion (30) forming an angle (A1, A2) of 45° to 65° with the lateral edge (11) of the first portion (10) from which the second portion (30) extends.

13. The structure according to claim 1, in which the metal connection parts are produced by folding a metal sheet made of steel with a thickness of 2 to 6 mm (0.787402 to 0.23622 inches).

14. The structure according to claim 1, in which the first and second portions (10, 30) have first openings (41) configured for allowing the passage of a stem of a bolt with a diameter of more than 5 mm (0.19685 inches), and in which at least one first opening (41) of the second portion (30) of a first connection part, of which the first portion (10) of the part in consideration is housed in the channel (G1, G2) of an I-shaped wooden beam, being arranged so as to cooperate with a first opening (41) of the first portion (10) of a connection part similar to the first part in consideration and which is housed in the channel (G1,G2) of another I-shaped wooden beam (PI).

15. The structure according to claim 1, in which the longitudinal folds (20, 21) each have a height of less comprised between 0.5 cm and 4 cm (0.19685 to 1.5748 inches).

16. The structure according to claim 1, in which the second portion (30) has a maximum height (HM) between 0.5 and 1 times the distance separating the longitudinal reinforcement folds (21, 22) from one another, while the distance separating the longitudinal reinforcement folds (20,21) from one another is equal to 5 to 12 times the maximum height (HM) of the longitudinal folds (20, 21).

17. The structure according to claim 1, in which the two lateral end edges (11, 12) of the first portion (10) are spaced apart from one another by a distance equal to 1 to 2 times the distance separating the longitudinal folds (20, 21) from one another.

18. The structure according to claim 1, in which the structure includes at least one element selected from the group consisting of panels that are supported on the I-shaped or U-shaped beam, insulating elements situated in the volume defined between the beams, and combinations thereof.

19. A structure comprising at least four wooden beams each comprising a wooden web, said beams being attached to one another so as to define at least one substantially rectangular frame, in which at least two of said four beams defining a substantially rectangular frame are I-shaped or U-shaped wooden beams, each I-shaped or U-shaped beam including at least (a) a planar central wooden web (2) having two opposite faces, a first longitudinal edge, a second longitudinal edge opposite to the first longitudinal edge, a first lateral end edge and a second lateral end edge opposite to the first lateral end edge, (b) a first longitudinal wooden wing (3) extending along the first longitudinal edge, (c) a second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, and (d) in the vicinity of at least one lateral end edge of the planar wooden web, at least one longitudinal intermediate wooden reinforcement situated between said first and second longitudinal wooden wings (3), whereby said at least first longitudinal wooden wing, second longitudinal wooden wing (3) and said longitudinal intermediate wooden reinforcement are attached to said planar central wooden web (2) while defining along one face of the central wooden web (2), in the vicinity of the at least one lateral end edge, between said at least first longitudinal wing and second longitudinal wing (3), at least a first longitudinal channel and a second longitudinal channel distinct from the said first longitudinal channel, said first longitudinal channel and said second longitudinal channel having each a bottom extending along the planar central wooden web and with two opposite faces extending from the said bottom, said opposite faces of a considered channel being selected from the group consisting of a face of the first longitudinal wooden wing, a face of the second longitudinal wing and faces of the at least one intermediate wooden reinforcement, the said two opposite faces being distant the one to the other by a distance defining the width of the considered channel and defining therebetween a channel volume, whereby said at least four wooden beams defining the substantially rectangular frame are attached to one another by means of at least two distinct metal connection parts (1) and fixation means connecting the said at least two metal connection parts (1) to wooden beams of said at least four wooden beams defining the substantially rectangular frame, said at least one connection metal part being formed by folding a metal plate element, whereby each of said at least two metal connection parts (1) has at least a first flat being supported on one of the opposite faces of a considered longitudinal channel (G1,G2) of a considered I-shaped or U-shaped beam (PU,PI) with at least one intermediate wooden reinforcement, a second flat being supported on the other of said opposite faces of the considered longitudinal channel (G1, G2) of said considered I-shaped or U-shaped beam (PU, PI) with at least one intermediate wooden reinforcement, and at least one third flat that is supported at least on the central wooden web (2) of another beam (P) connected to said considered I-shaped or U-shaped beam (PU,PI) with the at least one intermediate wooden reinforcement, said metal connection part positioned between a respective said U-shaped or I-shaped beam (PU, PI) and another said beam comprising:

a first substantially rectangular portion (10) having two lateral end edges (11, 12) and two longitudinal edges (13, 14) which are spaced apart from one another by a distance corresponding substantially to the width of the longitudinal channel (G1, G2) of the I-shaped or U-shaped beam in consideration (PI, PU) provided with the said at least one intermediate wooden reinforcement, a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to the plane in which the first portion (10) extends and extending on a same side with respect to the plane in which the first portion (10) extends, said first and second longitudinal reinforcement folds (20, 21) having a maximum height (HM) measured from the first portion (10), said maximum height being adapted so that, when the first portion (10) is supported on the bottom of the considered channel (G1, G2) of the I-shaped or U-shaped beam in consideration (PI, PU) provided with the said at least one intermediate wooden reinforcement, the longitudinal reinforcement folds (20, 21) extend in the channel volume defined by said considered channel (G1, G2) and are the said first flap (20) and the second flap (21) contacting the opposite faces of the considered channel (G1,G2), and a second portion (30) lengthening the first portion (10) along one (11) of the lateral end edges thereof (11, 12), said second portion (30) extending in a plane substantially perpendicular to the plane in which the first portion (10) extends, the said second portion (30) having a maximum length (LM), calculated starting from said one lateral end edge (11) of the first portion (10), which is at least equal to 1.2 times the maximum height (HM) of the said first and second longitudinal reinforcement folds (20, 21), wherein the first portion (10), the first longitudinal reinforcement fold (20), the second longitudinal reinforcement fold (21) and the second portion (30) of said metal connection part are provided with openings (41,42) cooperating with said fixation means (100).

20. The structure of claim 19, in which the first longitudinal wing and the second longitudinal wing each comprise a series of wooden sheets glued one another.

21. The structure of claim 20, in which the first wooden longitudinal wing, the second wooden longitudinal wing and the wooden longitudinal intermediate reinforcements each comprise a series of wooden sheets glued one another.

22. The structure according to claim 19, in which the planar central wooden web (2) of the I-shaped or U-shaped beams of the substantially rectangular frame extends each within a plane, and in which the wooden longitudinal wings (3) and the wooden longitudinal intermediate reinforcements (RE) of one of the said I-shaped or U-shaped beams of the substantially rectangular frame comprises a series of glued wooden sheets selected among the group consisting of a series of wooden sheets extending each in a plane parallel to the plane of the planar central wooden web (2), a series of wooden sheets extending each in a plane perpendicular to the plane of the planar central wooden web, and combination thereof.

23. The structure of claim 19, in which the I-shaped or U-shaped beams are provided in the vicinity of the first lateral end edge with a first longitudinal intermediate wooden reinforcement and in the vicinity of the second lateral end edge with a second longitudinal intermediate wooden reinforcement separated from the said first longitudinal intermediate wooden reinforcement.

24. The structure according to claim 19, wherein said four beams are at least four I-shaped or U-shaped wooden beams defining the substantially rectangular frame, each said I-shaped or U-shaped beam including said at least (a) planar central wooden web (2) having the two opposite faces, the first longitudinal edge, the second longitudinal edge opposite to the first longitudinal edge, the first lateral end edge and the second lateral end edge opposite to the first lateral end edge, (b) the first longitudinal wooden wing (3) comprising a first series of wooden sheets glued one another, said first longitudinal wooden wing (3) extending along the first longitudinal edge, (c) the second longitudinal wooden wing (3) comprising a second series of wooden sheets glued one another, said second longitudinal wooden wing (3) extending along the second longitudinal edge, whereby said first longitudinal wooden wing and said longitudinal wooden wing being spaced apart from one another while extending along at least one of the two opposite faces in the vicinity of the longitudinal edges, (d) in the vicinity of the first lateral end edge, the first longitudinal intermediate wooden reinforcement and (e) in the vicinity of the second lateral end edge, a second longitudinal intermediate wooden reinforcement separated from the said first longitudinal intermediate wooden reinforcement, whereby each of said metal connection part connecting a first beam of said four I-shaped or U-shaped beams with the first intermediate wooden reinforcement to a second beam of said four I-shaped or U-shaped beams with the second intermediate wooden reinforcement has said at least first flat (20) being supported on one of the opposite faces of the considered channel (G1,G2) of the first beam, as well on one of the opposite faces of the considered channel of the said second beam, and said second flat (21) being supported on the other of the opposite faces of the considered channel (G1,G2) of the first beam, as well on the other of the opposite faces of the considered channel of the said second beam.

25. The structure according to claim 19, in which the planar central wooden web (2) of the I-shaped or U-shaped beams of the substantially rectangular frame extends each within a plane, in which the wings (3) of the at least two I-shaped or U-shaped beams of the substantially rectangular frame comprises glued wooden sheets extending each in a plane parallel to the plane of the planar central wooden web (2), and in which the longitudinal intermediate wooden reinforcements comprise glued wooden sheets extending each in a plane parallel to the plane of the planar central wooden web (2).

26. The structure according to claim 19, characterized in that the longitudinal intermediate wooden reinforcements have a length of 20 to 50 cm (7.87402 to 19.685 inches).

27. The structure according to claim 19, in which each of said connection part (1) connecting the one beam to another beam of the said four beams defining the substantially rectangular frame defines a spatial zone with a first face extending along the first portion (10) and with a second face extending along the second portion, whereby the first longitudinal fold (20) and the second longitudinal fold (21) extend in the said spatial zone of the said considered connection part.

28. The structure according to claim 19, in which said second portion (30) has a shape or section of substantially trapezoidal or triangular shape with opposite first and second lateral edges (31, 32) that approach one another the farther the opposite first and second lateral edges (31, 32) from said lateral edge (11) of the first portion (10).

29. The structure according to claim 19, in which the first and second lateral edges (31, 32) of the second portion (30) have each at least an inclined edge portion, the said inclined edge portion of the first lateral edge and the said inclined portion of the second lateral edge extend along lines forming an angle (A1, A2) of less than 85° with the lateral edge (11) of the first portion (10) from which the said second portion (30) extends.

30. The structure according to claim 29, in which the second portion (30) lengthening the first portion (10) along one (11) of the lateral edges thereof (11,12) extends in a plane perpendicular to the plane in which the first portion (10) extends, the second portion (30) having a maximum length (LM), calculated starting from said lateral edge (11) of the first portion (10), which is at least equal to two times the maximum height (HM) of the longitudinal folds (20, 21).

31. The structure according to claim 30, in which the second portion (30) has a maximum length (LM), calculated starting from said lateral edge (11) of the first portion (10), which is 1.5 times to 10 times the maximum height (HM) of the longitudinal folds (20,21).

32. The structure according to claim 19, in which said second portion (30) has a shape or section of substantially triangular shape with opposite first and second lateral edges (31, 32) that approach one another the farther the opposite first and second lateral edges (31, 32) get from said lateral edge (11) of the first portion (10), and in which the second portion (30) has a substantially triangular shape, the lateral edges (31, 32) of the second portion (30) forming an angle (A1, A2) of 45° to 65° with the lateral edge (11) of the first portion (10) from which the second portion (30) extends.

33. The structure according to claim 19, in which the metal connection parts are produced by folding a metal sheet made of steel with a thickness of 2 to 6 mm (0.787402 to 0.23622 inches).

34. The structure according to claim 19, in which the first and second portions (10, 30) have first openings (41) configured for allowing the passage of a stem of a bolt with a diameter of more than 5 mm (0.19685 inches), and in which at least one first opening (41) of the second portion (30) of a first connection part, of which the first portion (10) of the part in consideration is housed in one channel (G1, G2) of an I-shaped wooden beam, is arranged so as to cooperate with a first opening (41) of the first portion (10) of a connection part similar to the first part in consideration and which is housed in one channel (G1,G2) of another I-shaped wooden beam (PI).

35. The structure according to claim 19, characterized in that the longitudinal folds (20, 21) each have a height of less comprised between 0.5 cm and 4 cm (0.19685 to 1.5748 inches).

36. The structure according to claim 19, in which the second portion (30) has a maximum height (HM) between 0.5 and 1 times the distance separating the longitudinal reinforcement folds (21, 22) from one another, while the distance separating the longitudinal reinforcement folds (20,21) from one another is equal to 5 to 12 times the maximum height (HM) of the longitudinal folds (20, 21).

37. The structure according to claim 19, in which the two lateral end edges (11, 12) of the first portion (10) are spaced apart from one another by a distance equal to 1 to 2 times the distance separating the longitudinal folds (20, 21) from one another.

38. The structure according to claim 19, in which the structure includes at least one element selected from the group consisting of panels that are supported on the I-shaped or U-shaped beam, insulating elements situated in the volume defined between the beams, and combinations thereof.

39. A metal connection part obtained by folding of a metal plate, said connection part configured for connecting a U-shaped or I-shaped beam (PU, PI) and another beam, said I-shaped or U-shaped beam defining with respect to a planar central wooden web and longitudinal wooden wings in a vicinity of lateral ends at least one longitudinal channel, whereby said connection part comprises:

a first substantially rectangular portion (10) having two lateral edges (11, 12) and two longitudinal edges (13, 14) which are spaced apart from one another by a distance corresponding substantially to a width of one of said longitudinal channel (G1, G2) of the I-shaped or U-shaped beam in consideration (PI, PU), the said first portion having openings (41,42) for fixation means (100) adapted to attach said first portion to the planar central wooden web;

a first longitudinal reinforcement fold (20) lengthening the first portion along a first (13) of the longitudinal edges thereof (13,14) and a second longitudinal reinforcement fold (21) lengthening the first portion (10) along the second (14) of the longitudinal edges (13, 14), said longitudinal reinforcement folds (20, 21) extending in a plane substantially perpendicular to a plane in which the first portion (10) extends and extending on a same side with respect to the plane in which the first portion (10) extends, said longitudinal folds (20, 21) having a maximum height (HM) adapted so that, when the first portion (10) is supported on a bottom of one channel (G1, G2) of the I-shaped or U-shaped beam in consideration (PI, PU), the longitudinal folds (20, 21) extend in a volume defined by said one channel (G1, G2), and a second portion (30) lengthening the first portion (10) along one (11) of the lateral edges thereof (11, 12), said second portion (30) extending in a plane perpendicular to the plane in which the first portion (10) extends, the second portion (30) moreover having a first maximum length (LM), calculated starting from said lateral edge (11) of the first portion (10), which is at least equal to 1.2 times the maximum height (HM) of the longitudinal folds (20, 21), the said second portion configured to contact the planar wooden web of the another beam and being provided with openings (41,42) for fixation means (100), in which the second portion (30) moreover having a second maximum length (LM), calculated starting from said lateral edge (11) of the first portion (10), which is at least equal to two times the maximum height (HM) of the longitudinal folds (20, 21), in which the longitudinal folds (20, 21) extend in a spatial zone situated above the plane of the second portion (30) and including the first portion (10), and in which lateral edges (31, 32) of the second portion (30) each form an angle (A1, A2) of less than 85° with the lateral edge (11) of the first portion (10) from which the second portion (30) extends.

40. The connection part according to claim 39, in which the second portion (30) has a third maximum length (LM), calculated starting from said lateral edge (11) of the first portion (10), which is at least equal to two to ten times the maximum height (HM) of the longitudinal folds.

41. The part according to claim 39, in which the metal connection parts are produced by folding a metal sheet made of steel with a thickness of 2 to 6 mm (0.787402 to 0.23622 inches).

* * * * *